US006452554B1

(12) United States Patent
Aoyama et al.

(10) Patent No.: US 6,452,554 B1
(45) Date of Patent: Sep. 17, 2002

(54) ANTENNA ELEMENT AND RADIO COMMUNICATION APPARATUS

(75) Inventors: Hiroyuki Aoyama; Koji Fukamachi, both of Saitama-ken; Toshimasa Kawamura, Ibaraki-ken; Hiroshi Okabe, Tokyo; Ken Takei, Kanagawa-ken, all of (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 09/434,942

(22) Filed: Nov. 5, 1999

(30) Foreign Application Priority Data

Nov. 6, 1998 (JP) ..... 10-316159

(51) Int. Cl.[7] ..... H01Q 1/24; H01Q 13/10
(52) U.S. Cl. ..... 343/702; 343/767
(58) Field of Search ..... 343/767, 700 MS, 343/702; H01Q 13/00, 1/24, 1/38, 13/10

(56) References Cited

U.S. PATENT DOCUMENTS 2,990,547 A * 6/1961 McDougal ..... 343/767
5,442,367 A * 8/1995 Naito et al. ..... 343/767
5,821,902 A * 10/1998 Keen ..... 343/702
5,914,693 A 6/1999 Takei et al. ..... 343/767
5,940,041 A * 8/1999 Koyama et al. ..... 343/767

* cited by examiner

*Primary Examiner*—Michael C. Wimer
(74) *Attorney, Agent, or Firm*—Finnegan, Henderson, Farabow, Garrett & Dunner, L.L.P.

(57) ABSTRACT

An antenna element comprises an insulating substrate; a first conductor layer formed continuously on an upper surface, a bottom surface and at least one side surface of the insulating substrate; a strip gap consisting of a portion in which a conductor layer is not formed on an upper surface and/or a side surface of the insulating substrate; and a second strip conductor layer formed in the slot or in an insulated extension connected to the strip gap thereby being electrically insulated from the first conductor layer, the second conductor layer being electrically connected to a feeder. The first conductor layer formed on an upper surface of the insulating substrate is divided by at least one slit gap extending substantially in perpendicular to the direction of electric current at a position separated from the strip gap.

18 Claims, 22 Drawing Sheets

ANTENNA ELEMENT AND RADIO COMMUNICATION APPARATUS

FIELD OF THE INVENTION

The present invention relates to an antenna element suitable for radio systems such as portable radio communications apparatuses using microwaves, quasi microwaves or millimeteric waves, and particularly to an antenna element that is to be mounted in microwave radio communications apparatuses for an intelligent transport system (ITS), etc. such as vehicle information and communications systems (VICS) and electronic toll collection systems (ETC), and further to a radio communications apparatus comprising such an antenna element.

PRIOR ART

According to recent demand of miniaturization and cost reduction of microwave radio communications apparatuses, there is strong demand to reduce the size of antennas mounted in microwave radio communications apparatuses. For instance, used in cellular phones are generally monopole antennas that are retractable in bodies of cellular phones. From the aspect of improvement in portability, further miniaturization and reduction in weight of antennas and the mounting of antennas in bodies of phones are desired.

Widely used as built-in antennas are conventionally inverted F-type antennas and micro-strip antennas that are constituted by monopole antennas bent in parallel with a ground for miniaturization and reduction in thickness. However, because an antenna of this type utilizes a phone body as a ground, the dimension of a phone body affects the radiation directionality of an antenna, and part of electric current induced in a phone body by the radiation of electromagnetic waves from the antenna flows into a hand of a person holding the phone. Also, because sufficient bandwidth and gain are not obtained, the overall size of the antenna should be large to obtain bandwidth and gain almost comparable to those of the monopole antenna, whereby it cannot easily be installed in small radio communications apparatuses such as recent cellular phones.

Thus, pole antennas are disadvantageous in inconvenience and restriction in the freedom of design. Therefore, a coaxial resonant slot antenna having a structure in which a strip conductor is disposed in an internal space of a flat box-shaped conductor cubic in an insulated manner so that it is operable in a transverse electromagnetic mode (TEM) was proposed (U.S. Pat. No. 5,914,693). The structure of this slot antenna is shown in FIGS. 50 (*a*) and (*b*). This slot antenna is constituted by bonding an insulating substrate 501*a* having a slot 503 formed by the pattern etching of a conductor layer 502 to an insulating substrate 501*b* having a strip conductor layer 504 formed by the etching of a conductor layer.

When transmission is carried out by this coaxial resonant slot antenna, a high-frequency signal supplied from a feeder flows through a strip conductor layer 504 to the slot 503, from which it is radiated to the sky by a resonance phenomenon of the slot 503. Also, in the case of reception, an electromagnetic wave (received signal) introduced into the conductor cubic through the slot 503 progresses through the strip conductor layer 504 in a direction opposite to the above direction and picked up by a feeder as a high-frequency signal.

However, because this coaxial resonant slot antenna has a structure in which an insulating substrate 501*a* having a slot 503 is bonded to an insulating substrate 501*b* having a strip conductor layer 504, an electromagnetic coupling coefficient is susceptible to variation due to relative displacement between the slot 503 and the strip conductor layer 504 that is likely to occur in their bonding step, resulting in large variation in a resonance frequency and a voltage-standing wave ratio (VSWR) representing the condition of impedance matching. To reduce variation in VSWR, the insulating substrates 501*a*, 501*b*, the slot 503 and the strip conductor layer 504 should be formed at high precision, and the insulating substrates 501*a* and 501*b* should also be bonded precisely, resulting in complicated production processes.

In the case of mounting a slot antenna, an apparent impedance of the antenna varies by a floating capacitance between a ground pattern in contact with the slot antenna and a body of a microwave radio communications apparatus. Accordingly, impedance matching should be achieved between the slot antenna and the feeder system. However, because the above coaxial resonant slot antenna has a structure in which the strip conductor layer is disposed in a conductor cubic, the impedance matching cannot easily be achieved. In addition, because the coaxial resonant slot antenna should be designed in a manner matching with the shapes of the board and body of the microwave radio communications apparatus, there arises a problem of extremely increased production cost in cellular phones, etc. whose specifications are frequently modified.

In addition to the above coaxial resonant slot antenna, there is a rectangular hollow slot antenna having a shape shown in FIG. 51 (see "Antenna Engineering Handbook," page 89). This rectangular hollow slot antenna comprises a slot 3 on an upper surface of a first flat conductor 2, and high-frequency electric power terminals OSCs at both ends of the slot 3, and OSCs serve to receive a signal and emit radio waves.

The specifications required for the built-in antennas as described above depend on systems in which they are used. For instance, in US-PCS (the United States) or K-PCS (Korea) utilizing a cellular phone system of 1.9 GHz band (2 GHz band in the global standard CDMA system), frequency bandwidths shown in Table 1 below are necessary.

TABLE 1

| Frequency Specifications | US-PCS (bandwidth) | K-PCS (bandwidth) |
|---|---|---|
| Transmission Frequency | 1850–1910 MHz (60 MHz) | 1750–1780 MHz (30 MHz) |
| Reception Frequency | 1930–1990 MHz (60 MHz) | 1840–1870 MHz (30 MHz) |

However, the rectangular hollow slot antenna as shown in FIG. 51 does not meet the above specifications of antennas. Also, because a wider bandwidth is more effective to prevent the deterioration of performance due to the variation of use environment in a small antenna mounted in a cellular phone, it is important to expand the bandwidth of the antenna. The principle for expanding bandwidth is as follows. At a bandwidth Bw, the following equation is met.

$$Bw - 1/Q \quad (1).$$

Thus, the smaller the Q, the more the bandwidth Bw expands. Also, at a radiation efficiency η, the following equation is met.

$$\eta = 1/(1+Qr/Qi) \quad (2).$$

wherein Qi=Qc+Qd, Qc and Qd are the values of Q by conductor loss and dielectric loss, respectively, and Qr is the value of Q by radiation. Therefore, when Qr is small, the radiation efficiency $\eta$ is large.

Thus, the element should have a small Q to expand the bandwidth, and Qr should be small to increase the radiation efficiency $\eta$. For instance, in the case of an antenna for a cellular phone, the bandwidth of 20 MHz is needed.

$$Q\ \omega C \quad (3),$$

$$C=a\cdot\epsilon_r \quad (4),$$

wherein $\omega$ is an angular frequency, C is capacitance, a is a constant determined by the antenna shape, and $\epsilon$ is a dielectric constant.

The following relation is satisfied from the equations (3) and (4).

$$Q\ \omega\cdot a\cdot\epsilon_r \quad (5).$$

It is known from the equation (5) that a material having a small dielectric constant should be used to keep the Q low.

Also, there is a relation between Qr and the thickness (height) of an antenna, which is $$Qr\ 1/t \quad (6),$$

wherein t is a thickness (height) of an antenna. Thus, the antenna should be made thick to decrease Qr.

Further, the slot antenna having a shape shown in FIG. 51 is disadvantageous in that power of radio waves emitted from the antenna (radiation gain) is small. Thus, in the conventional slot antenna, a material having a small dielectric constant such as a glass-filled epoxy resin, Teflon, etc. is used to decrease the Q, thereby increasing the bandwidth. Here, assuming that the slot shown in FIG. 51 has a length L, the following relations are satisfied.

$$L=\lambda/2 \quad (7),$$

$$\lambda=\lambda_0/\sqrt{\epsilon} \quad (8),$$

$$\epsilon=(1+\epsilon_r)/2 \quad (9),$$

wherein $\lambda_0$ is a wavelength in vacuum, $\lambda$ is a wavelength compressed by a dielectric body, $\epsilon$ is an effective dielectric constant, and $\epsilon_r$ is a dielectric constant.

Because a material having a small dielectric constant provides a small wavelength compression ratio, a signal resonating in the antenna has a short wavelength, thereby failing to reduce the length L of the antenna slot. Also, when a material having a large dielectric constant is used, the antenna should be made thick to decrease the Q, thereby expanding the bandwidth. However, when a high slot antenna is mounted inside a cellular phone, the cellular phone inevitably becomes large, resulting in the reduced freedom of design. In addition, a small radiation gain makes it impossible to send radio waves far enough, causing increase in transmission error. Accordingly, an antenna having a large radiation gain is necessary.

Accordingly, an object of the present invention is to provide a small, thin antenna element having a low Q and large frequency bandwidth and radiation gain, particularly a slot antenna free from large variations of resonance frequency and VSWR and easily achieving impedance matching with a feeder, which is produced with a small number of steps.

SUMMARY OF THE INVENTION

As a result of intense research in view of the above object, the inventors have found that a slot antenna-type antenna element constituted by a radiation conductor layer formed on an upper surface of an insulating substrate, a slot provided on an upper surface and/or a side surface of the insulating substrate, and a strip conductor layer formed inside the slot such that it is electrically insulated from the radiation conductor layer is small and thin, providing low Q and large frequency bandwidth and radiation gain, and that at least one slit gap provided in a radiation conductor layer for dividing the radiation conductor layer in an electric current direction serves to further reduce Q of the antenna element, thereby further increasing the frequency bandwidth and the radiation gain. The present invention has been completed based on these findings.

Thus, the antenna element of the present invention comprises an insulating substrate; a first conductor layer formed continuously on an upper surface, a bottom surface and at least one side surface of the insulating substrate; a slot consisting of a portion in which a conductor layer is not formed on an upper surface and/or a side surface of the insulating substrate; and a second strip conductor layer formed in the slot or in an insulated extension connected to the slot thereby being electrically insulated from the first conductor layer, the second conductor layer being electrically connected to a feeder. With such a constitution, an electromagnetic coupling coefficient between the second strip conductor layer and the slot is easily controlled.

The second strip conductor layer preferably has at a tip end an extension that is trimmed to control the length of the second strip conductor layer. With the length of the strip conductor layer controlled by trimming the extension by laser or other means, impedance matching with the feeder can easily be achieved.

The slot is preferably provided on at least one side surface of the insulating substrate. The second conductor layer preferably exists in the slot at a position opposite to the side surface of the insulating substrate on which the first conductor layer is formed.

The first conductor layer formed on an upper surface of the insulating substrate is preferably divided by at least one slit gap extending substantially in perpendicular to the electric current direction at a position separated from the slot. A radiation region of the first conductor layer is preferably divided into three parts by a plurality of slit gaps. Also, the slit gap is preferably in parallel with the slot.

A ratio $S_b/S_a$ of an area $S_b$ of the slit gap to an area $S_a$ of the radiation region of the first conductor layer is preferably 0.05 or more. Also, a ratio c/a of a distance c from the second conductor layer to the slit gap to a distance $\alpha$ from the second conductor layer to the side surface of the insulating substrate, on which the first conductor layer is formed, is preferably 0.1 or more.

The insulating substrate of the above antenna element is preferably made of a ceramic based on alumina or calcium zirconate.

BRIEF DESCRIPTION OF THE DRAWINGS

FIG. 1(*b*) is a perspective view showing from below the slot antenna of FIG. 1(*a*);

FIG. 1(*c*) is an A—A cross-sectional view of FIG. 1(*a*);

FIG. 12(*b*) is a plan view showing the slot antenna of FIG. 12(*a*);

FIG. 12(*c*) is a B—B cross-sectional view of FIG. 12(*b*);

FIG. 43(*b*) is a graph showing the relation between input return loss and frequency in a slot antenna in EXAMPLE 1;

FIG. 44(*b*) is a graph showing the relation between input return loss and frequency in a slot antenna in EXAMPLE 2;

FIG. 50(*b*) is a C—C cross-sectional view of FIG. 50(*a*); and

DESCRIPTION OF PREFERRED EMBODIMENTS OF THE INVENTION

The slot antenna of the present invention is constituted by an insulating substrate, a first conductor layer, and a second conductor layer, and materials for these constituents may be common in embodiments described below. A material for each element is as follows:

From the aspect of the characteristics of a slot antenna, the insulating substrate is preferably made of dielectric ceramics such as barium titanate, calcium titanate, calcium zirconate, lead titanate, lead titanate zirconate, alumina, etc. and low-loss dielectric materials such as glass-filled epoxy resins, Teflon, etc. When the slot antenna is operated in a frequency bandwidth of up to 1 GHz, the insulating substrate may be made of soft magnetic materials having a relative permeability of less than 10, such as Ni—Cu—Zn ferrite, etc.

Both of the first and second conductor layers are preferably made of metal materials having low electric resistance such as Au, Pt, Ag, Cu or alloys thereof. These conductor layers may be formed on the insulating substrate by screen-printing pastes based on the above metal materials, or by depositing or plating them.

Figure 1A:
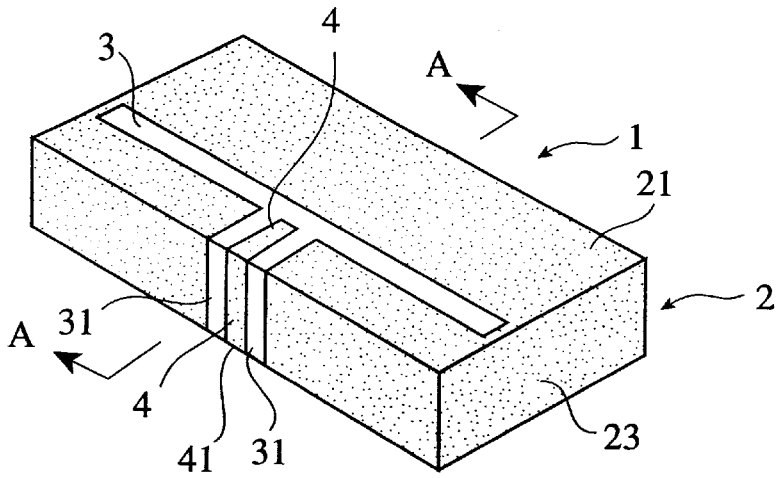
FIG. 1(*a*) is a perspective view showing from above a slot antenna according to one embodiment of the present invention.
Figure 1B:
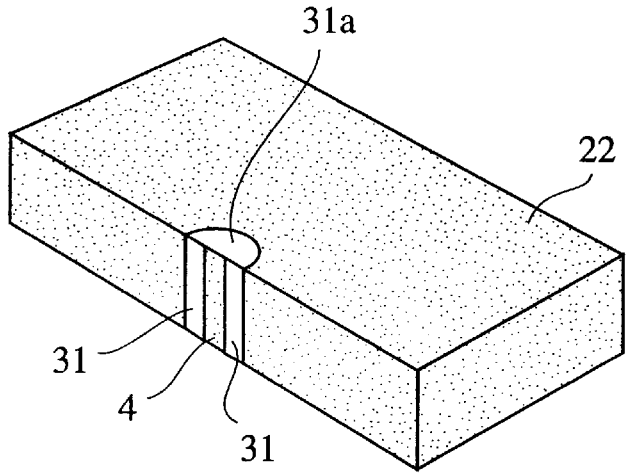
Figure 1C:
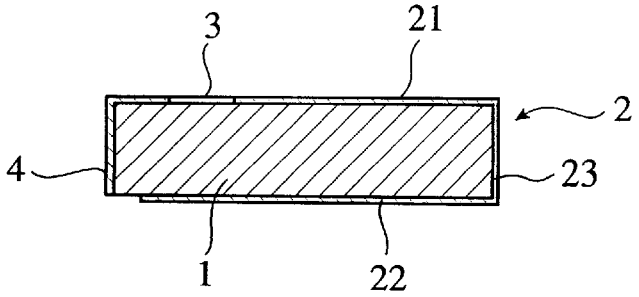

FIG. 1(*a*) is a perspective view showing a slot antenna, which is an antenna element according to one embodiment of the present invention. FIG. 1(*b*) is a perspective view showing from rear the slot antenna of FIG. 1(*a*), and FIG. 1(*c*) is an A—A cross-sectional view of FIG. 1(*a*). This slot antenna comprises a first conductor layer 2 covering an outer surface of the insulating substrate 1, a slot 3 formed in the first conductor layer 2, an insulated extension 31 extending substantially perpendicularly from a center of the strip gap 3 toward an edge of the insulating substrate 1, and a second strip conductor layer 4 formed in the insulated extension 31 with electric insulation from the first conductor layer 2.

The first conductor layer 2 is constituted by a radiation conductor layer 21 formed on an upper surface of the insulating substrate 1, a ground conductor layer 22 formed on a bottom surface of the insulating substrate 1, and a conductor layer 23 formed on a side surface of the insulating substrate 1 for contacting the radiation conductor layer 21 with the ground conductor layer 22. In an example shown in FIG. 1(*b*), the insulated extension 31 is in a half-circular shape in the bottom surface of the insulating substrate 1, so that the second conductor layer 4 positioned at a center thereof is kept from contact with the surrounding first conductor layer 2 and the ground of a circuit board.

Figure 2:
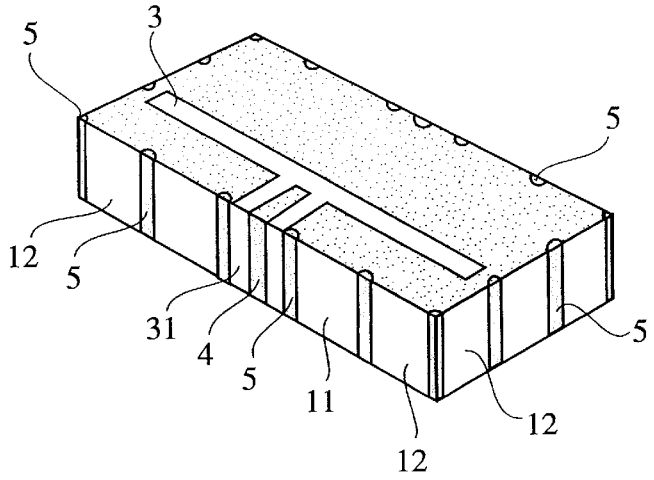
FIG. 2 is a perspective view showing from above a slot antenna according to another embodiment of the present invention.

FIG. 2 shows a slot antenna according to another embodiment of the present invention. This slot antenna is constituted by an insulated extension 31 continuous to the strip gap 3 and a plurality of conductor layers 5 on a side surface of the insulating substrate 1. This slot antenna is substantially the same as the slot antenna shown in FIG. 1, except for a plurality of conductor layers 5 provided on a side surface of the insulating substrate 1.

Figure 3:
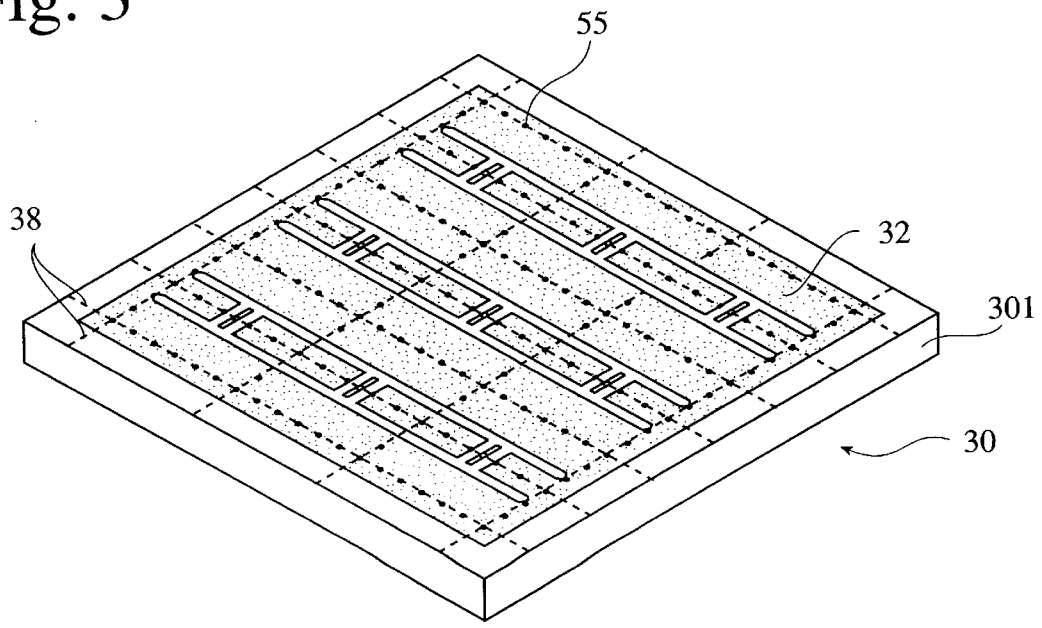
FIG. 3 is a perspective view showing an integral assembly for simultaneously producing a plurality of slot antennas of FIG. 2.

FIG. 3 is a perspective view showing an integral assembly 30 from which a plurality of slot antenna can be taken. The integral assembly 30 can be divided into each slot antenna shown in FIG. 2. The integral assembly 30 is constituted by a large insulating substrate 301, and a conductor layer 32 formed on an upper surface of the insulating substrate 301, and the conductor layer 32 is provided with vacant areas in a pattern corresponding to each strip gap 3 and each insulated extension 31. The insulating substrate 301 is also formed with a plurality of through-holes 55 at positions corresponding to the conductor layers 5, and the through-holes 55 are filled with a conductive material. Therefore, when the integral assembly 30 is divided as shown in FIG. 3, a plurality of conductor layers 5 appear on cut surfaces.

Figure 4:
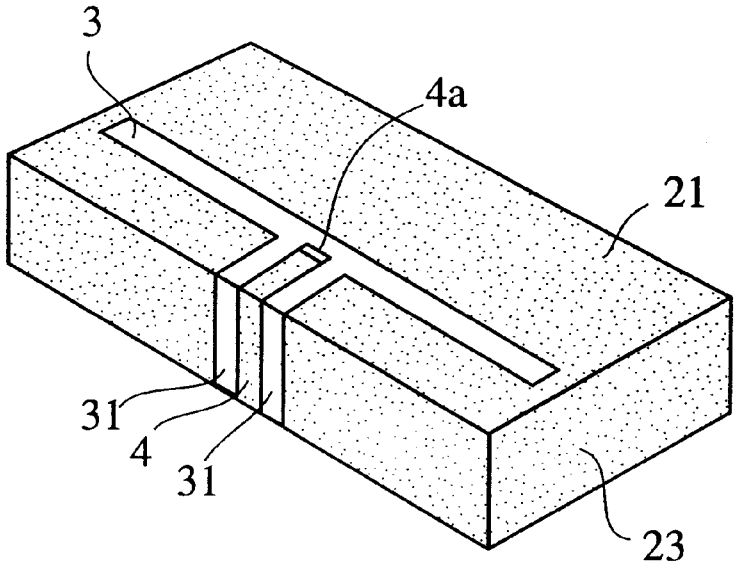
FIGS. 4–7 are respectively perspective views showing slot antennas according to other embodiments of the present invention.

FIG. 4 is a perspective view showing a slot antenna according to a further embodiment of the present invention. In this slot antenna, an extension 4*a* that is to be trimmed is formed at an end of the second strip conductor layer 4 on the side of the slot 3. The extension 4*a* is integral with the second conductor layer 4, extending into the strip gap 3. the extension 4*a* is trimmed by a predetermined length using a laser beam such as YAG laser, excimer laser, carbon dioxide laser or a mechanical means. The length of the extension 4*a* trimmed may be controlled properly, for instance, by adjusting the focusing of a laser beam. Because the absorption of a laser beam varies depending on the material of the second strip conductor layer 4, the type of a laser beam is preferably determined based on the material of the second conductor layer 4. Incidentally, it should be noted that this slot antenna is substantially the same as the slot antenna shown in FIG. 1 except for the extension 4*a* of the second conductor layer 4.

Figure 5:
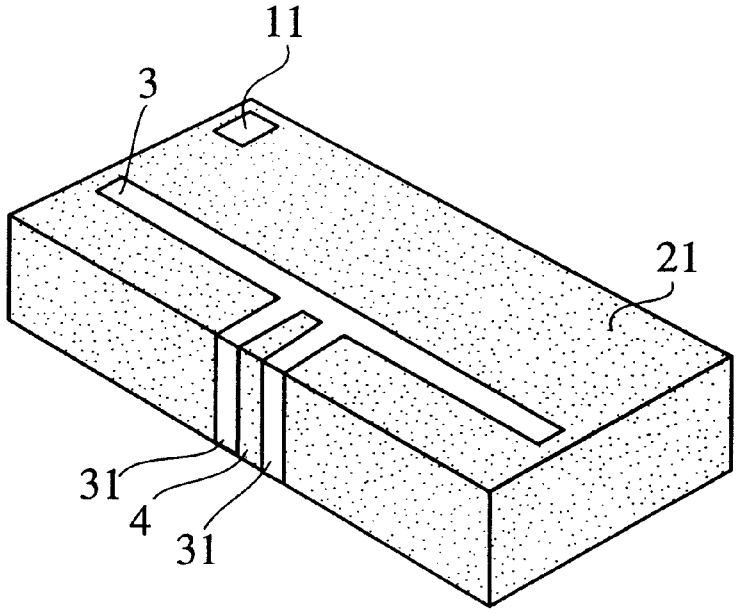
Figure 6:
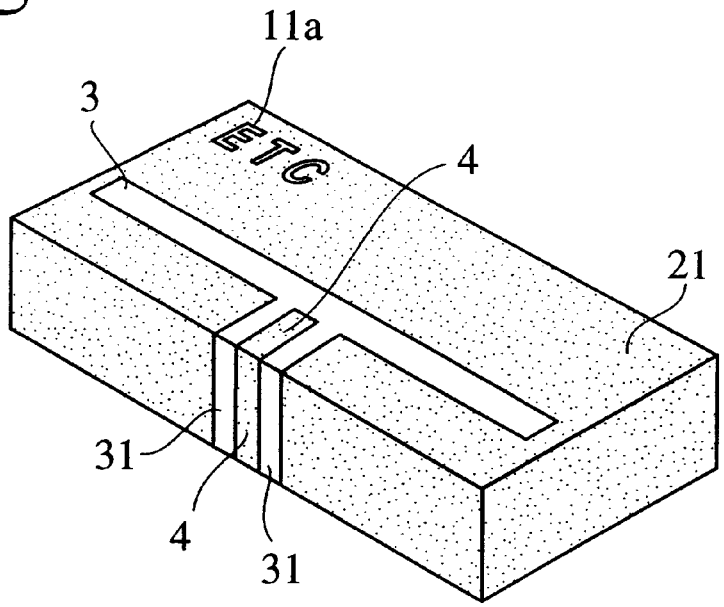

FIG. 5 is a perspective view showing a slot antenna according to a further embodiment of the present invention. This slot antenna comprises a strip gap 3 and discontinuous, rectangular openings 11. FIG. 6 is a perspective view showing a slot antenna of a design having letter-shaped openings 11. As shown in FIG. 6, using the strip gap 3 and the discontinuous openings 11 as marks for identifying the slot antenna, errors in identifying them can be prevented in the production process.

When the opening 11 is in a rectangular shape, it is preferably as narrow as ¼ or less of the total length of the strip gap 3, and one side of the opening 11 is as short as 1/100 or less of the wavelength of an electromagnetic wave. With this structure, an electromagnetic wave can be prevented from leaking from the opening 11. Incidentally, it should be noted that these slot antennas are substantially the same as the slot antenna shown in FIG. 1 except for the opening 11.

Figure 7:
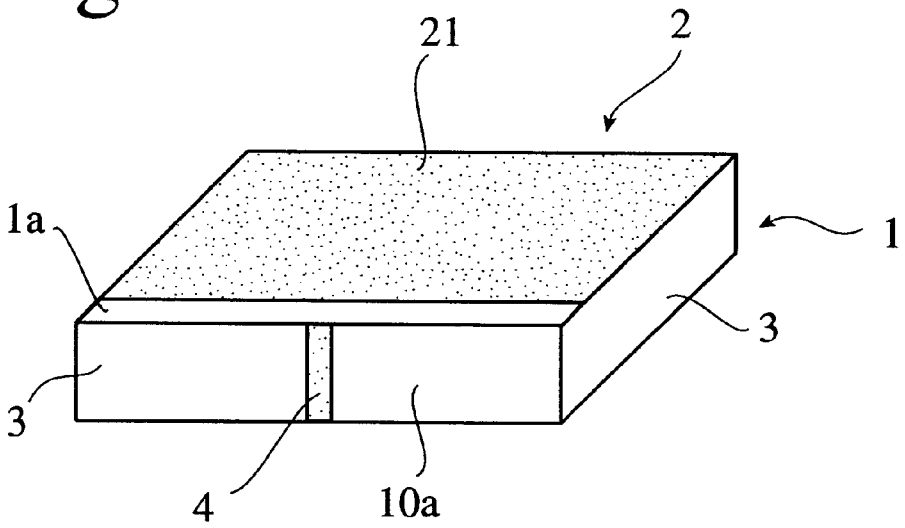

FIG. 7 is a perspective view showing a slot antenna according to a still other embodiment of the present invention. This slot antenna comprises a first conductor layer 2 continuously formed on an upper surface, a bottom surface and a side surface of the insulating substrate 1, and a second strip conductor layer 4 formed on a side surface of the insulating substrate 1 opposite to the side surface on which the first conductor layer 2 is formed. The first conductor layer on an upper surface of the insulating substrate 1 is called "radiation conductor layer 21," and the first conductor layer 2 on the bottom surface is called "ground conductor layer" (not shown). Also, the side surface on which the first conductor layer (not shown) for connecting the radiation conductor layer 21 with the ground conductor layer is formed is called "conductor layer-formed side surface." To prevent the first conductor layer 2 from being in contact with the second conductor layer 4, an end of the radiation conductor layer 21 (on the side of the second conductor layer 4) slightly recedes, thereby forming a conductor layer-free portion 1*a*.

A side surface 10*a* opposite to the conductor layer-formed side surface and side surfaces adjacent thereto are free from a conductor layer, thereby serving as a strip gap 3. The second strip conductor layer 4 extends substantially in a center of the side surface 10*a* in a thickness direction of the insulating substrate 1.

Figure 8:
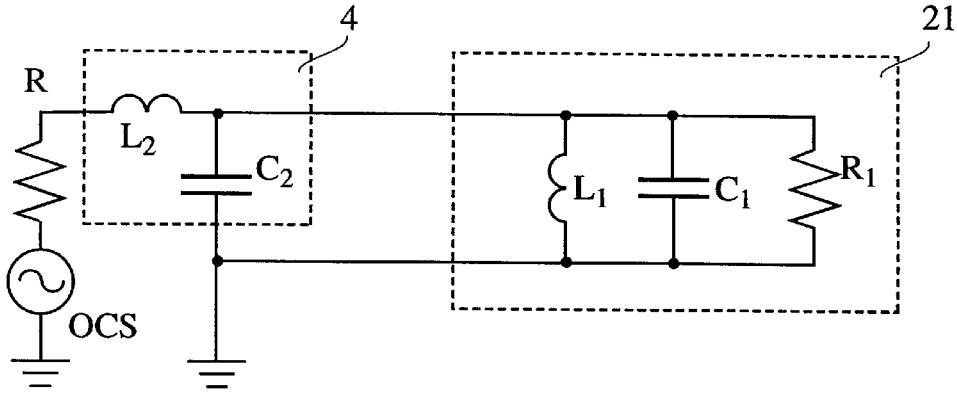
FIG. 8 is a view showing an equivalent circuit of the slot antenna of FIG. 7.

FIG. 8 shows an equivalent circuit of the slot antenna of FIG. 7. An antenna resonator by the radiation conductor layer 21 is expressed by an equivalent circuit comprising radiation loss and a resonator, and this equivalent circuit is constituted by a resistor $R_1$, a capacitance $C_1$ and a coil $L_1$. Also, an equivalent circuit of the second conductor layer 4 is a matching circuit constituted by a capacitance $C_2$ and a coil $L_e$.

Figure 11:
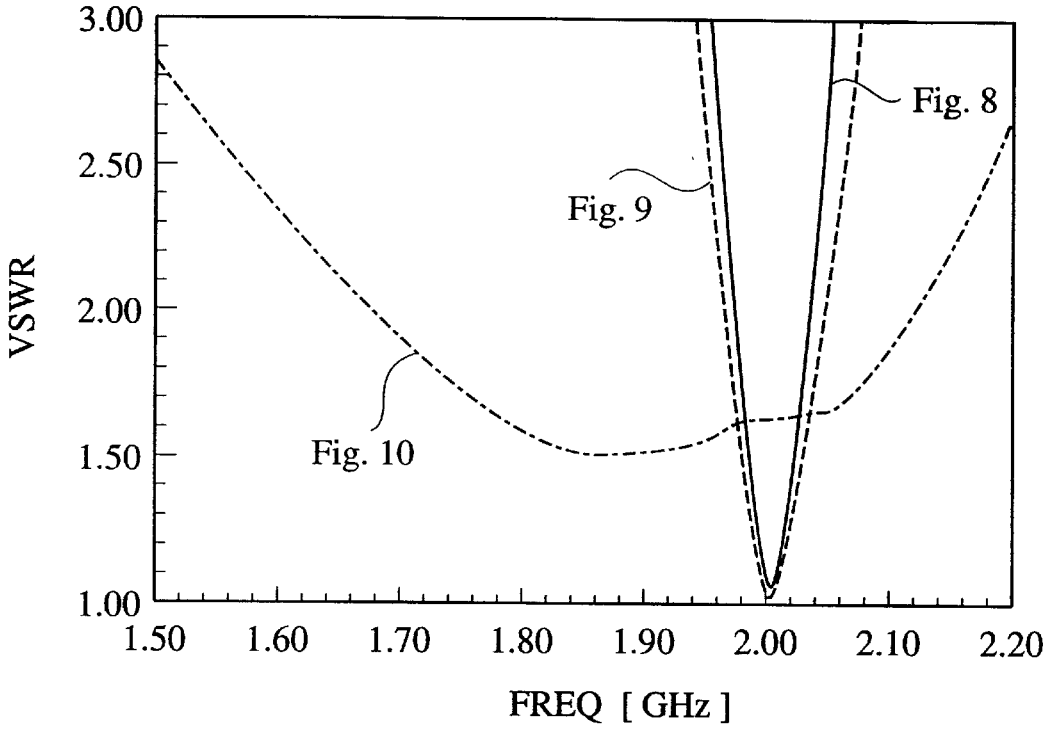
FIG. 11 is a graph showing the measurement results of bandwidth in the equivalent circuits shown in FIGS. 8–10.
Figure 51:
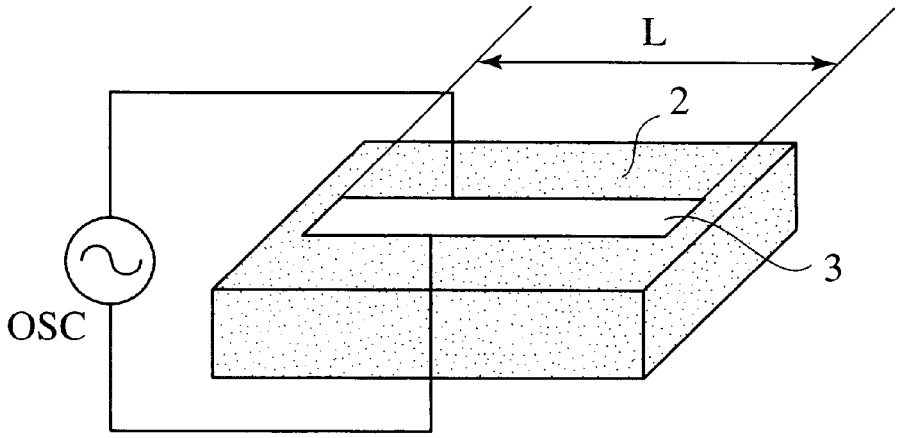
Fig.51 PRIOR ART
FIG. 51 is a perspective view showing another example of conventional slot antennas.

Because Q is expressed by the equation of Q $\omega R_1$, Q can be made small by reducing $R_1$. Because there is a large strip gap 3 on a side surface in the slot antenna shown in FIG. 7, the resistance $R_1$ is small as compared with the conventional slot antenna shown in FIG. 51, resulting in large frequency bandwidth and radiation gain of the antenna. One example of the measurement results of frequency bandwidth by this equivalent circuit is shown in FIG. 11 by a solid line.

Figure 9:
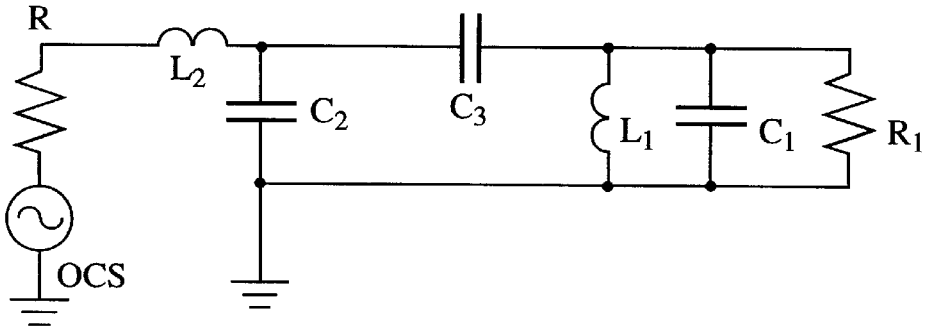
FIG. 9 is a view showing an equivalent circuit of a slot antenna comprising capacitance for expanding bandwidth.

Next, as shown in FIG. 9, a capacitance $C_3$ is connected in series between an antenna resonator and a matching circuit. One example of the measurement results of frequency bandwidth by this equivalent circuit is shown in FIG. 11 by a dotted line. Comparison between the solid curve and the dotted curve in FIG. 11 indicates that the dotted curve is wider in bandwidth.

Figure 10:
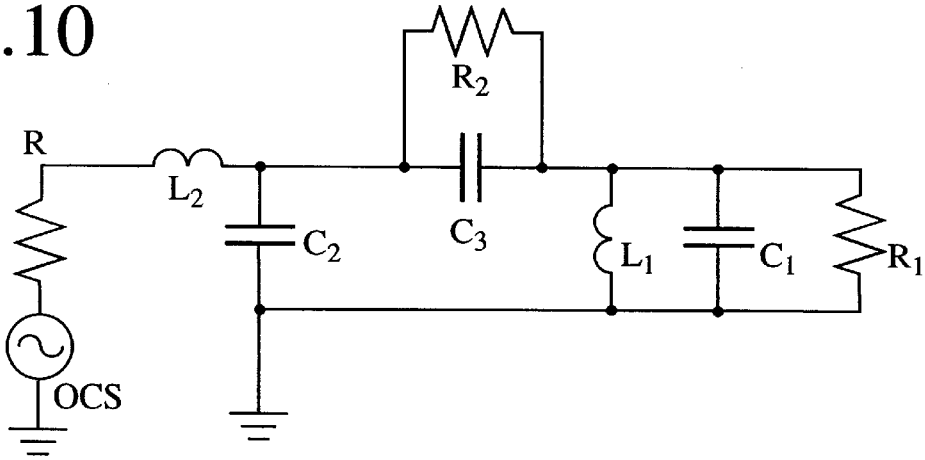
FIG. 10 is a view showing an equivalent circuit of a slot antenna comprising capacitance and resistance for increasing the bandwidth and radiation efficiency of the antenna.

Further, as shown in FIG. 10, a capacitance $C_3$ is connected to $R_2$ in parallel. The measurement results of a frequency bandwidth using this equivalent circuit are shown in FIG. 11 by a broken line. As shown by the broken curve line in FIG. 11, the equivalent circuit of FIG. 10 extremely, expands a frequency bandwidth. Because there is radiation of radio waves by the radiation loss $R_2$, the radiation gain also increases.

Figure 12A:
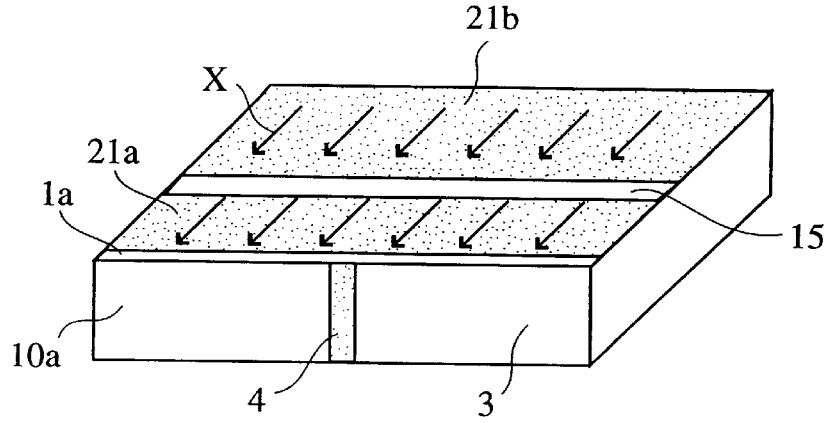
FIG. 12(*a*) is a perspective view showing from above a slot antenna according to a further embodiment of the present invention.
Figure 12B:
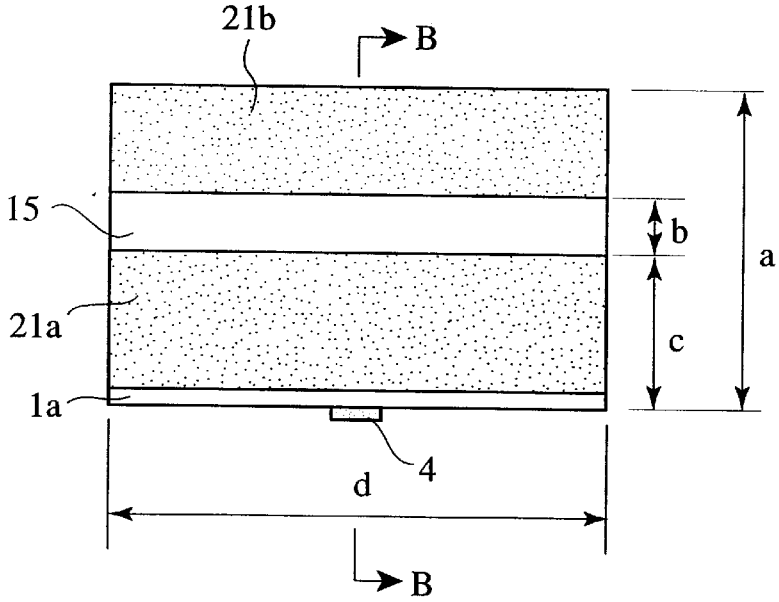
Figure 12C:
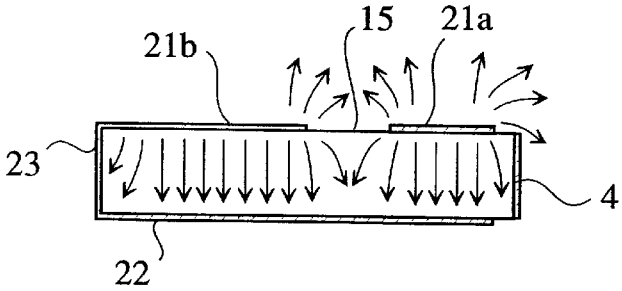

It is clear from the above results that the slot antenna can be provided with increased frequency bandwidth by inserting capacitance $C_3$ and radiation loss $R_2$ in series between the second conductor layer 4 and the radiation conductor layer 21. FIG. 12(*a*) is a perspective view showing a slot antenna constituted from such a point of view according to a still further embodiment of the present invention. FIG. 12(*b*) is a plan view of the slot antenna of FIG. 12(*a*), and FIG. 12(*c*) is a B—B cross-sectional view of FIG. 12(*b*).

In the slot antenna of this embodiment, a first conductor layer 2 is formed continuously on an upper surface, a bottom surface and a side surface of the insulating substrate 1. The first conductor layer 2 on an upper surface of the insulating substrate 1 is called "radiation conductor layer 21," the first conductor layer 2 on the bottom surface is called "ground conductor layer 22," and the conductor layer formed on a side surface for connecting the radiation conductor layer 21 to the ground conductor layer 22 is called "connecting conductor layer 23." Only one of the side surfaces of the insulating substrate 1 is formed with the connecting conductor layer 23, and a side surface 10*a* of the insulating substrate 1 opposite to that side surface is formed with a second strip conductor layer 4. The side surface 10*a* and the adjacent side surfaces of the insulating substrate 1 constitute a strip gap 3.

The radiation conductor layer 21 on an upper surface of the insulating substrate 1 is divided into two parts, a first radiation conductor layer 21*a* and a second radiation conductor layer 21*b*, by a slit gap 15 extending in perpendicular to the direction of electric current (shown by the arrow X). There is capacitance in series between the divided radiation conductor layers 21*a* and 21*b*. Also, because a radio wave is emitted from the slit gap 15, causing radiation loss, the radiation loss of the slot antenna can be controlled. Incidentally, the arrow in FIG. 12(*c*) indicates electric line of force. Based on the above principle, the Q of the slot antenna can be reduced, while increasing both frequency bandwidth and radiation gain.

In FIG. 12(*b*), a ratio b/a of the width b of the slit gap 15 (parallel with the direction of electric current) to the length a of the radiation conductor layer 21 in a longitudinal direction parallel with the direction of electric current) is preferably 0.05 or more. Within this range of a ratio b/a, it is possible to obtain a small, thin antenna element having a wide bandwidth and a large radiation efficiency. The more preferred ratio b/a is 0.1–0.4.

In this embodiment, when a ratio c/a of a distance c from the second conductor layer 4 to the slit gap 15 to a distance a from the second conductor layer 4 to the side surface of the insulating substrate 1, on which the connecting conductor layer 23 is formed, is set at 0.1 or more, it is possible to obtain a small, thin antenna element having a wide bandwidth and a large radiation efficiency. The more preferred ratio c/a is 0.4–0.6.

In this embodiment, a ratio $S_b/S_a$ of an area $S_b$ of the slit gap 15 to an area $S_a$ of the radiation conductor layer 21 is preferably 0.05 or more.

The more preferred ratio $S_b/S_a$ is 0.2–0.6.

Figure 13:
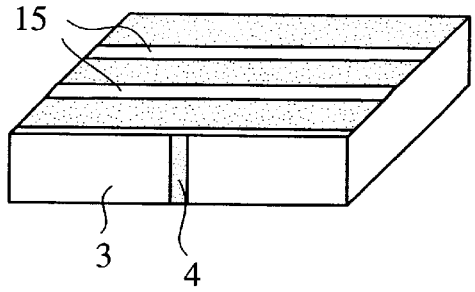
FIGS. 13–42 are respectively perspective views showing slot antennas according to further embodiments of the present invention.

The number of the slit gap 15 is not restricted to one, and a plurality of slit gaps 15 as shown in FIG. 13 serve to decrease Q, thereby providing an antenna element with large frequency bandwidth and radiation gain.

Examples of slot antennas provided with slit gaps 15 based on the above principle are shown in FIGS. 14–42.

Figure 14:
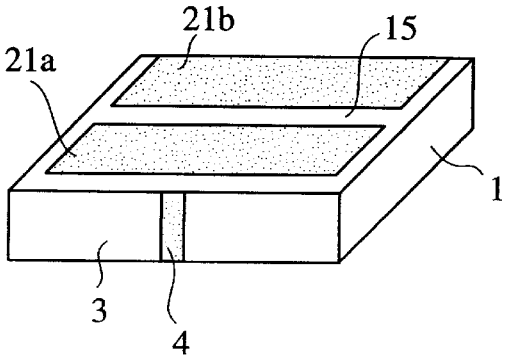

In a slot antenna shown in FIG. 14, a radiation conductor layer 21 is divided into a first radiation conductor layer 21*a* and a second radiation, conductor layer 21*b* by a slit gap 15, and peripheral edges of both radiation conductor layers 21*a*, 21*b* slightly recede from side edges of the insulating substrate 1 except on the side of a conductor layer-formed side surface. Except for this feature, this slot antenna is substantially the same as that shown in FIG. 12.

Figure 15:
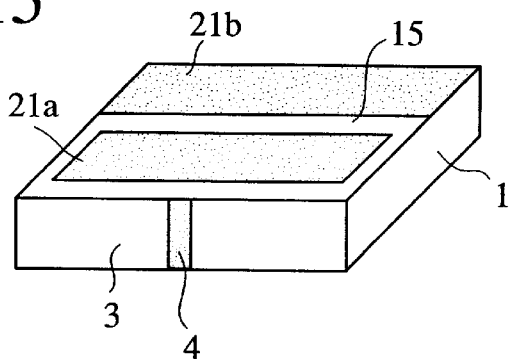

A slot antenna shown in FIG. 15 is substantially the same as that shown in FIG. 12, except that peripheral edges of a first radiation conductor layer 21*a* slightly recede from side edges of the insulating substrate 1.

Figure 16:
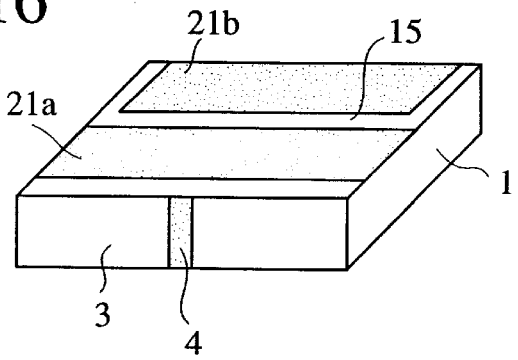

A slot antenna shown in FIG. 16 is substantially the same as that shown in FIG. 12, except that peripheral edges of a second radiation conductor layer 21*b* slightly recede from side edges of the insulating substrate 1 except on the side of a conductor layer-formed side surface.

Figure 17:
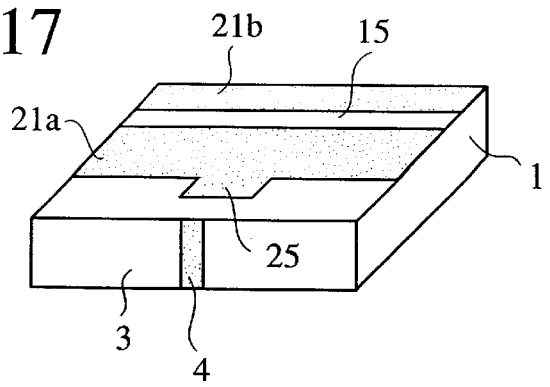

A slot antenna shown in FIG. 17 is substantially the same as that shown in FIG. 12, except that (a) a peripheral edge of a first radiation conductor layer 21*a* largely recedes from a side edge of the insulating substrate 1 on the side of a strip gap 3, and that (b) there is a projection 25 extending from the peripheral edge of the first radiation conductor layer 21*a*, such that a gap between the projection 25 and the second conductor layer 4 is narrow and adjustable.

Figure 18:
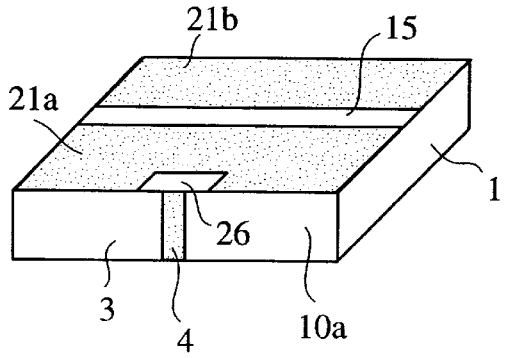

A slot antenna shown in FIG. 18 is substantially the same as that shown in FIG. 12, except that (a) a peripheral edge of a first radiation conductor layer 21*a* on the side of a strip gap 3 reaches a side edge of a side surface 10*a* provided with a second conductor layer 4, and that (b) there is a rectangular or half-circular notch 26 in a center of the peripheral edge of the first radiation conductor layer 21*a* on the side of a strip gap 3, with a gap between the notch 26 and the second conductor layer 4.

Figure 19:
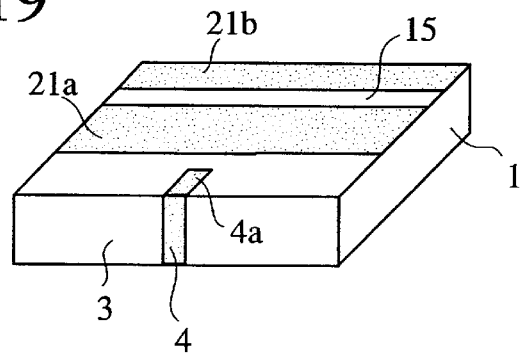

A slot antenna shown in FIG. 19 is substantially the same as that shown in FIG. 12, except that (a) a peripheral edge of a first radiation conductor layer 21*a* largely recedes from a side edge of the insulating substrate 1 on the side of a strip gap 3, and that (b) a second conductor layer 4 has an extension 4*a* projecting toward the first radiation conductor layer 21*a*, such that a gap between the extension 4*a* of the second conductor layer 4 and the first radiation conductor layer 21*a* is narrow and adjustable.

Figure 20:
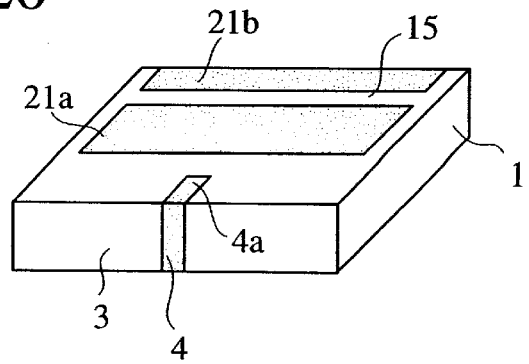

A slot antenna shown in FIG. 20 is substantially the same as that shown in FIG. 19, except that peripheral edges of a first radiation conductor layer 21*a* and a second radiation conductor layer 21*b* recede from side edges of the insulating substrate 1 except on the side of a conductor layer-formed side surface.

Figure 21:
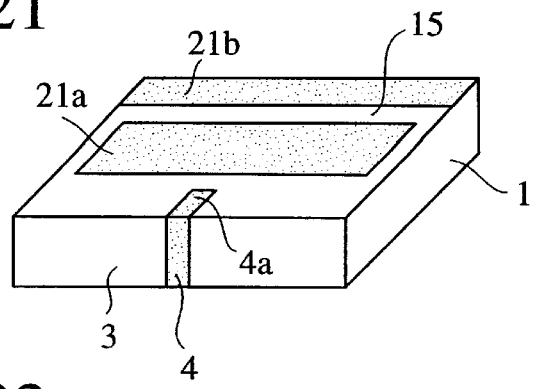

A slot antenna shown in FIG. 21 is substantially the same as that shown in FIG. 19, except that peripheral edges of a first radiation conductor layer 21*a* recede from side edges of the insulating substrate 1.

Figure 22:
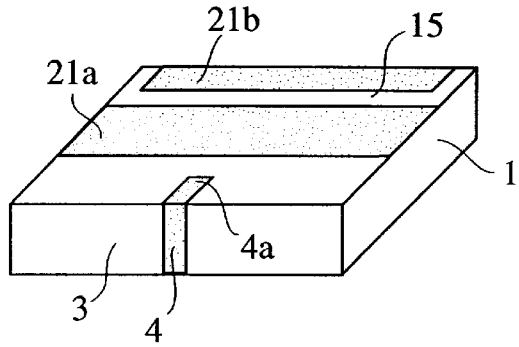

A slot antenna shown in FIG. 22 is substantially the same as that shown in FIG. 19, except that peripheral edges of a second radiation conductor layer 21*b* recede from side edges of the insulating substrate 1 except on the side of a conductor layer-formed side surface.

Figure 23:
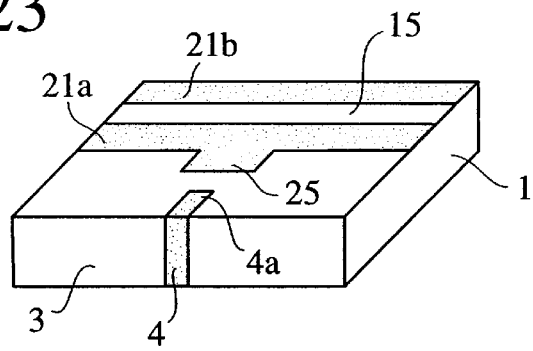

A slot antenna shown in FIG. 23 is substantially the same as that shown in FIG. 17, except that a second conductor layer 4 extends toward the first radiation conductor layer 21*a*, with a narrow, adjustable gap between the extension 4*a* of the second conductor layer 4 and the projection 25 of the first radiation conductor layer 21*a*.

Figure 24:
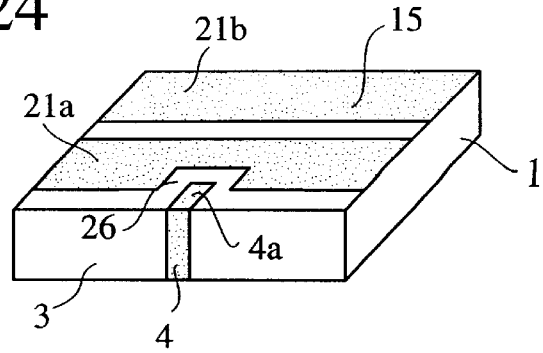

A slot antenna shown in FIG. 24 is substantially the same as that shown in FIG. 12, except that (a) there is a rectangular or half-circular notch 26 in a peripheral edge of the first radiation conductor layer 21*a* on the side of a strip gap 3, and that (b) a second conductor layer 4 has an extension 4*a* projecting toward the notch 26 of the first radiation conductor layer 21*a*, such that a gap between the extension 4*a* of the second conductor layer 4 and the notch 26 of the first radiation conductor layer 21*a* is narrow and adjustable.

Figure 25:
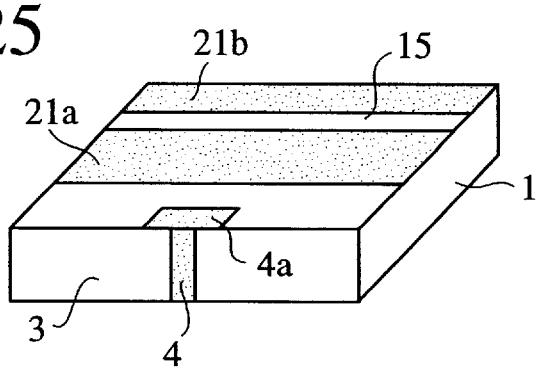

A slot antenna shown in FIG. 25 is substantially the same as that shown in FIG. 19, except that a second conductor layer 4 has at a tip end an larged extension 4*a* in a rectangular or half-circular shape.

Figure 26:
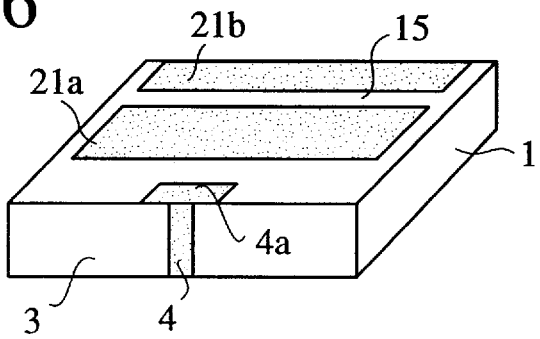

A slot antenna shown in FIG. 26 is substantially the same as that shown in FIG. 14, except that a second conductor layer 4 has at a tip end an enlarged extension 4*a* in a rectangular or half-circular shape.

Figure 27:
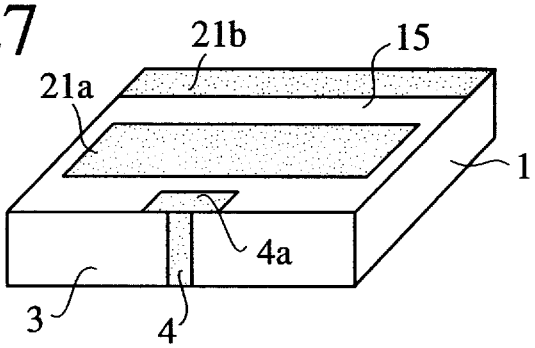

A slot antenna shown in FIG. 27 is substantially the same as that shown in FIG. 15, except that a second conductor layer 4 has at a tip end an enlarged extension 4*a* in a rectangular or half-circular shape.

Figure 28:
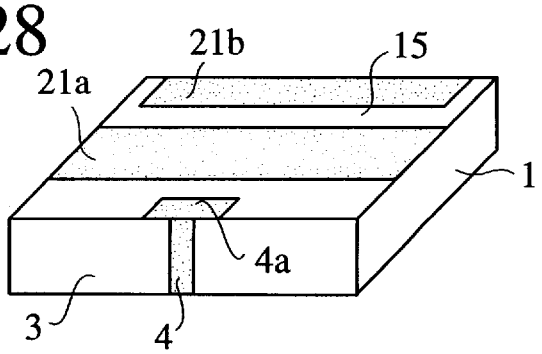

A slot antenna shown in FIG. 28 is substantially the same as that shown in FIG. 16, except that a second conductor layer 4 has at a tip end an enlarged extension 4*a* in a rectangular or half-circular shape.

Figure 29:
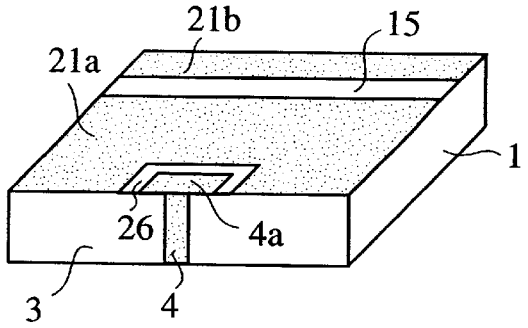

A slot antenna shown in FIG. 29 is substantially the same as that shown in FIG. 18, except that (a) a second conductor layer 4 has at a tip end an enlarged extension 4*a* in a rectangular or half-circular shape, and that (b) the extension 4*a* of the second conductor layer 4 enters into the notch 26 of the first radiation conductor layer 21*a* with a gap therebetween.

Figure 30:
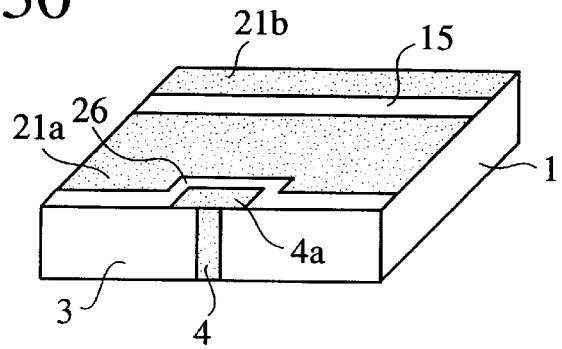

A slot antenna shown in FIG. 30 is substantially the same as that shown in FIG. 12, except that (a) there is a rectangular or half-circular notch 26 in a peripheral edge of the first radiation conductor layer 21*a* on the side of a strip gap 3, that (b) a second conductor layer 4 has at a tip end an enlarged extension 4*a* in a rectangular or half-circular shape, and that (c) the extension 4*a* of the second conductor layer 4 enters into the notch 26 of the first radiation conductor layer 21*a* with a gap therebetween.

Figure 31:
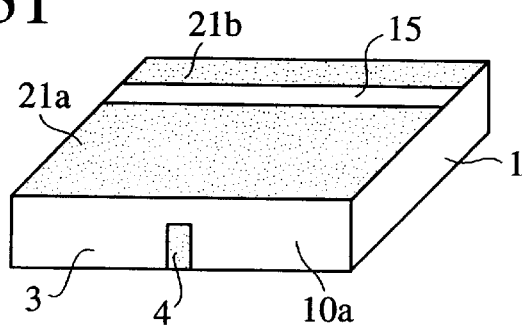

A slot antenna shown in FIG. 31 is substantially the same as that shown in FIG. 12, except that (a) a peripheral edge of a first radiation conductor layer 21*a* on the side of a strip gap 3 reaches a side edge of a side surface 10*a*, that (b) a second conductor layer 4 is shorter than the thickness of the insulating substrate 1, and that (c) there is a gap between the edge of the first radiation conductor layer 21*a* and the second conductor layer 4.

Figure 32:
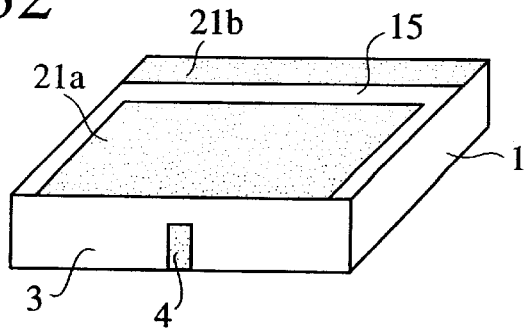

A slot antenna shown in FIG. 32 is substantially the same as that shown in FIG. 31, except that peripheral edges of the first radiation conductor layer 21*a* recede except on the side of a strip gap 3.

Figure 33:
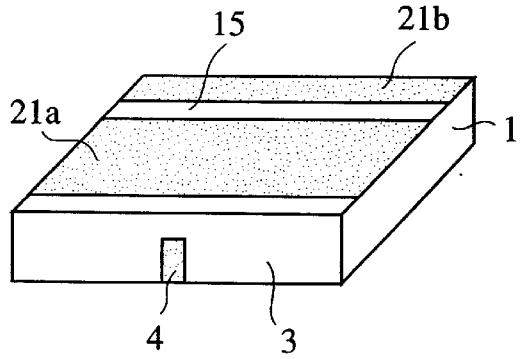

A slot antenna shown in FIG. 33 is substantially the same as that shown in FIG. 12, except that a second conductor layer 4 is shorter than the thickness of the insulating substrate 1.

Figure 34:
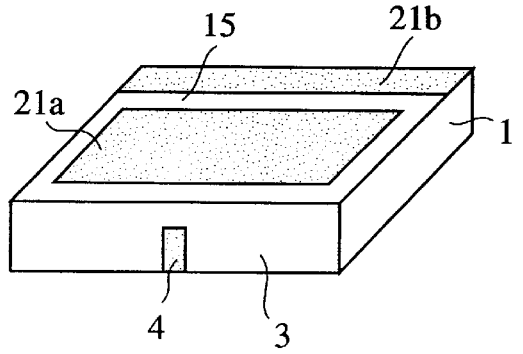

A slot antenna shown in FIG. 34 is substantially the same as that shown in FIG. 31, except that peripheral edges of the first radiation conductor layer 21*a* recede.

Figure 35:
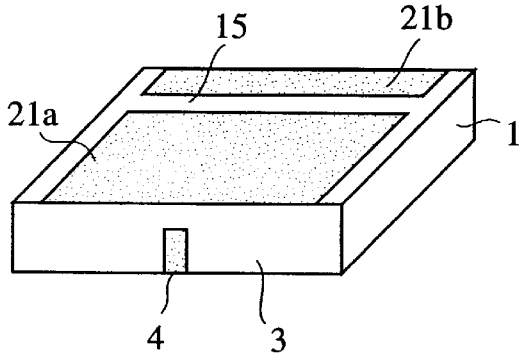

A slot antenna shown in FIG. 35 is substantially the same as that shown in FIG. 31, except that peripheral edges of a first radiation conductor layer 21*a* and a second radiation conductor layer 21*b* recede from side edges of the insulating substrate 1 except on the side of a conductor layer-formed side surface.

Figure 36:
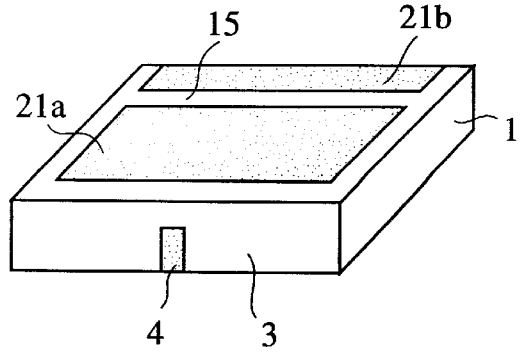

A slot antenna shown in FIG. 36 is substantially the same as that shown in FIG. 33, except that peripheral edges of a first radiation conductor layer 21*a* and a second radiation conductor layer 21*b* recede from side edges of the insulating substrate 1.

Figure 37:
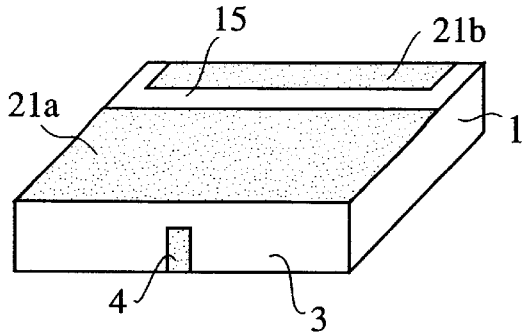

A slot antenna shown in FIG. 37 is substantially the same as that shown in FIG. 31, except that peripheral edges of a second radiation conductor layer 21*b* recede.

Figure 38:
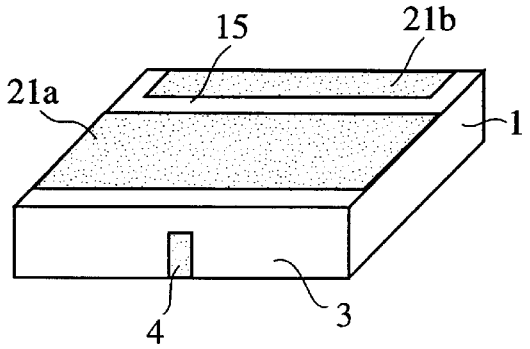

A slot antenna shown in FIG. 38 is substantially the same as that shown in FIG. 33, except that peripheral edges of a second radiation conductor layer 21*b* recede.

Figure 39:
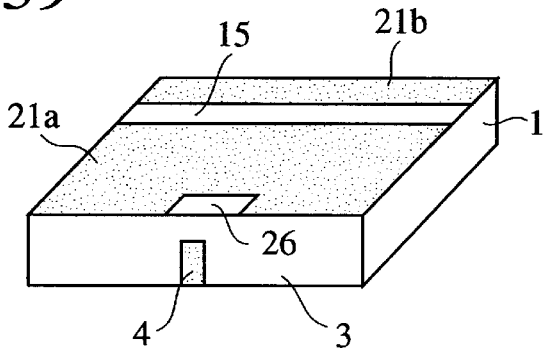

A slot antenna shown in FIG. 39 is substantially the same as that shown in FIG. 18, except that a second conductor layer 4 is shorter than the width of a side surface of the insulating substrate 1.

Figure 40:
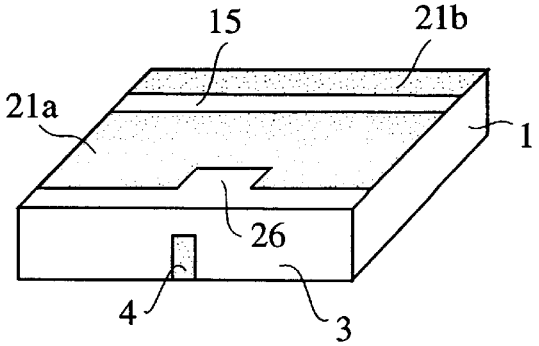

A slot antenna shown in FIG. 40 is substantially the same as that shown in FIG. 33, except that there is a rectangular or half-circular notch 26 in a peripheral edge of the first radiation conductor layer 21*a* on the side of a strip gap 3.

Figure 41:
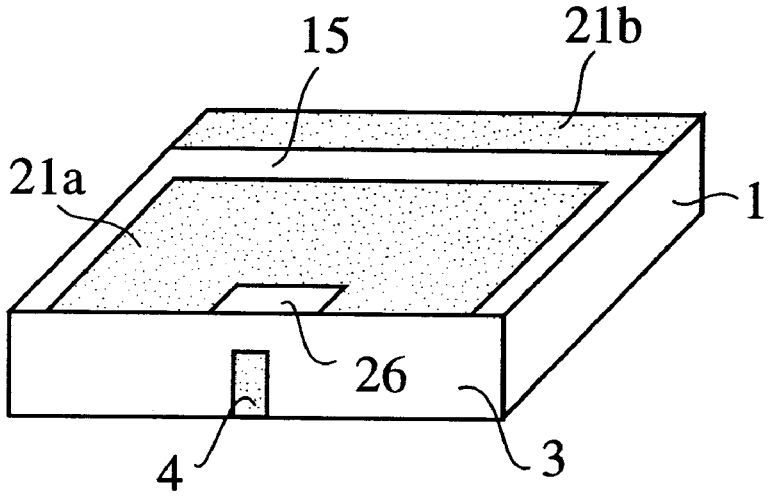

A slot antenna shown in FIG. 41 is substantially the same as that shown in FIG. 39, except that peripheral edges of the first radiation conductor layer 21*a* recede.

Figure 42:
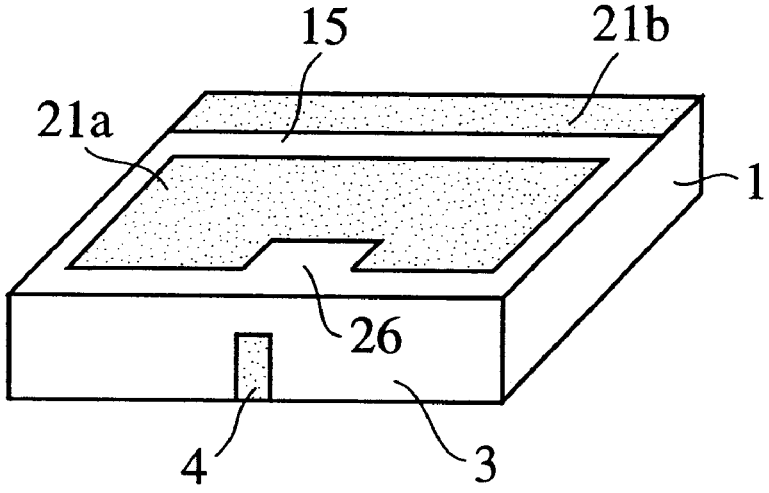

A slot antenna shown in FIG. 42 is substantially the same as that shown in FIG. 40, except that peripheral edges of the first radiation conductor layer 21*a* recede.

The present invention will be described in detail referring to EXAMPLES below, without intention of restricting the scope of the present invention thereto.

EXAMPLE 1, COMPARATIVE EXAMPLE 1

$Al_2O_3$, $SiO_2$, PbO, CaO, $Na_{2O}$ and $K_2O$ were formulated to provide a composition for alumina-based ceramics, mixed by wet ball milling, dried, crushed and calcined. The resultant calcined powder was mixed with polyvinyl alcohol (PVA) as a binder, compression-molded and then sintered. The resultant sintered body was cut by a dicing machine to a dielectric substrate of 15 nm in length, 7.5 mm in width and 3 mm in height having a dielectric constant $\epsilon_r$ of 8 and a dielectric loss tan δ of 0.0006 at 5.8 GHz.

Figure 50A:
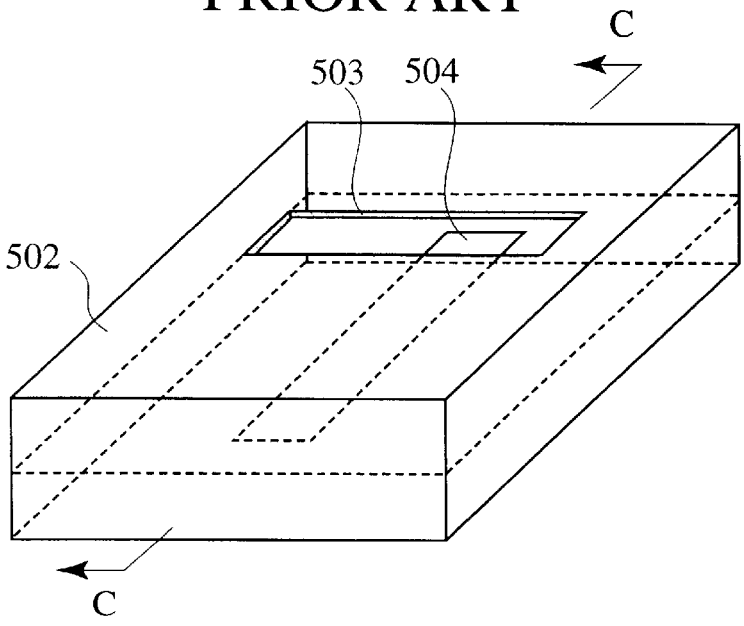
Fig. 50(a) PRIOR ART
FIG. 50(*a*) is a perspective view showing one example of conventional slot antennas.
Figure 50B:
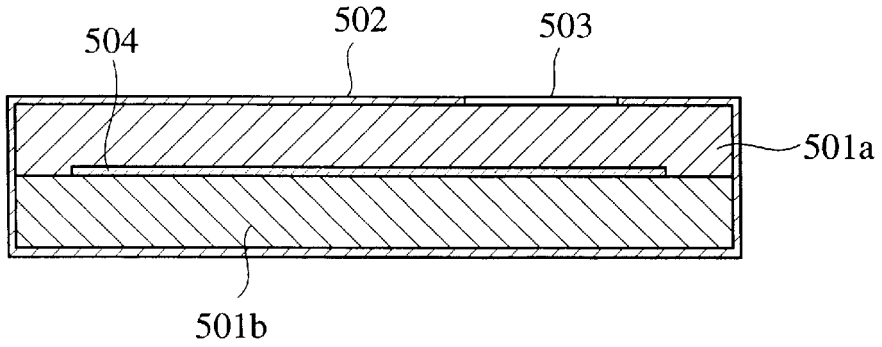
Fig. 50(b) PRIOR ART

An outer surface of each dielectric substrate 1 was coated with a conductive paste based on Ag by a screen printing method to form a first conductor layer 2 covering the entire surface of the dielectric substrate 1, a strip gap 3 and a second strip conductor layer 4 as shown in FIG. 1, and then baked at 850° C. to provide a slot antenna for ETC. The strip conductor layer 4 was formed such that it bad characteristic impedance matching at 50Ω. A gap between an end of the strip conductor layer 4 and the strip gap 3 (width: 1 mm) was set at 0.5 mm. Also as COMPARATIVE EXAMPLE, a conventional slot antenna shown in FIG. 50 was produced.

Figure 43A:
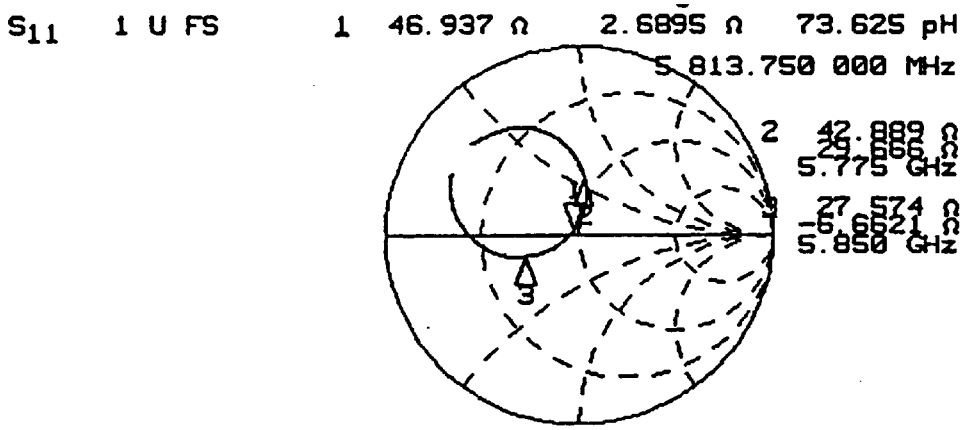
FIG. 43(*a*) is a Smith chart showing the characteristics of a slot antenna in EXAMPLE 1.
Figure 43B:
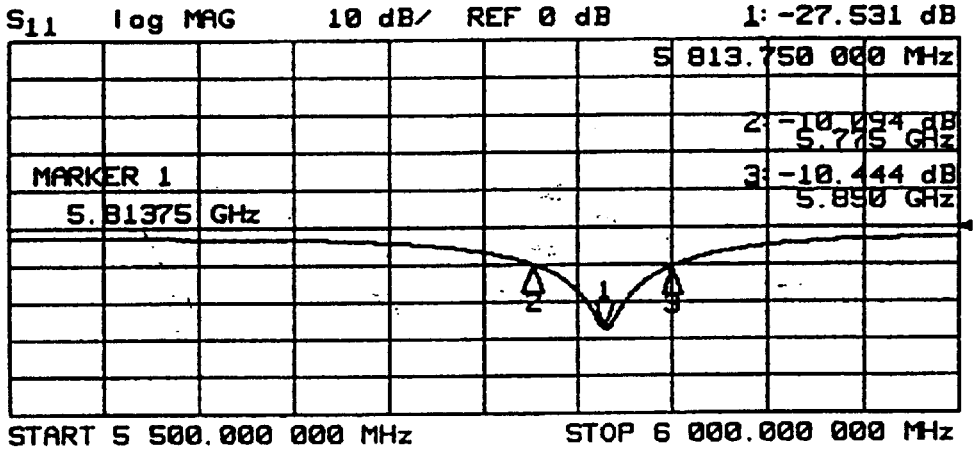

Each of the resultant samples was soldered to a substrate for evaluation, and evaluated with respect to input VSWR from a feeder using a network analyzer. FIG. 43(*a*) is a Smith chart of the slot antenna of EXAMPLE 1, and FIG. 43(*b*) shows the frequency characteristics of input return loss in the same slot antenna. It was found from FIG. 43 that the slot antenna of EXAMPLE 1 fully met the specifications of ETC mounted to vehicles (reception frequency= 5.795–5.805 GHz, transmission frequency =5.835–5.845 GHz, a bandwidth at return loss of 10 dB=5.775–5.850 GHz). The slot antenna of EXAMPLE 1 had a resonance frequency of 5.812–5.815 GHz, with as small scatter range as about 3 MHz, while the slot antenna of COMPARATIVE EXAMPLE 1 had a resonance frequency of 5.811–5.827 GHz, with as large scatter range as about 16 MHz. Also, some samples in COMPARATIVE EXAMPLE 1 failed to achieve the desired bandwidth with largely scattered VSWR values.

EXAMPLE 2

$Al_2O_3$, $SiO_2$, $ZrO_2$, $Bi_2O_3$, HfO and CaO were formulated to provide a composition for calcium zirconate-based ceramics, mixed by wet ball milling, dried, crushed and calcined. The resultant calcined powder was mixed with PVA as a binder, compression-molded and then sintered. The resultant sintered body was cut by a dicing machine to a dielectric substrate of 5 mm in length, 7.5 mm in width and 3 mm in height having a dielectric constant $\epsilon_r$, of 30 and a dielectric loss tan δ of 0.0002 at 2.5 GHz.

An outer surface of each dielectric substrate 1 was coated with a conductive paste based on Ag by a screen printing method to form a first conductor layer 2 covering the entire surface of the dielectric substrate 1, a strip gap 3 (width: 1 mm) and a second strip conductor layer 4 as shown in FIG. 1, and the conductive paste was baked at 850° C. to provide a slot antenna for VICS. The strip conductor layer 4 was formed such that it had characteristic impedance matching at 50Ω. A gap between an end of the strip conductor layer 4 and the strip gap 3 was set at 0.5 mm.

Figure 44A:
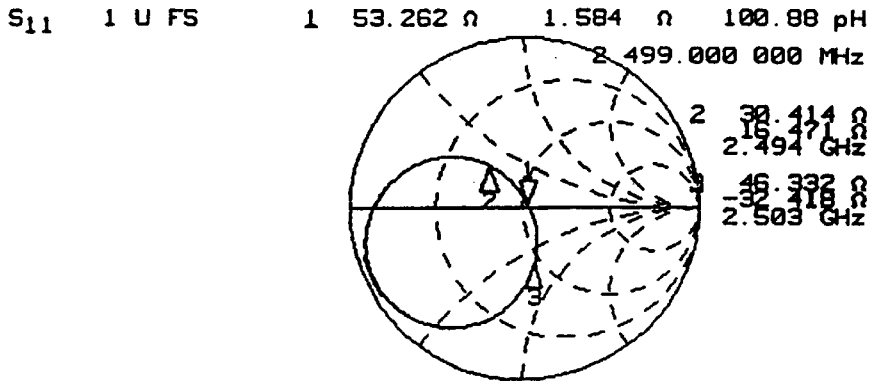
FIG. 44(*a*) is a Smith chart showing the characteristics of a slot antenna in EXAMPLE 2.
Figure 44B:
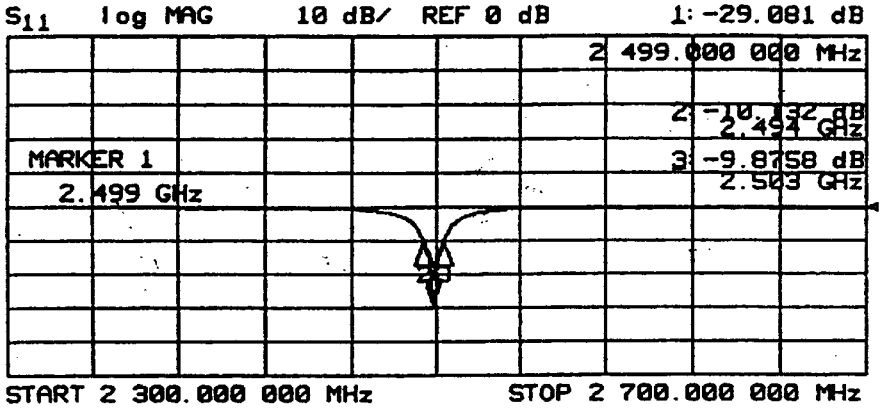

Each of the resultant samples was soldered to a substrate for evaluation, and evaluated with respect to input VSWR from a feeder using a network analyzer. FIG. 44(*a*) is a Smith chart of the slot antenna of EXAMPLE 2, and FIG. 44(*b*) shows the frequency characteristics of input return loss in the same slot antenna. It was found that the slot antenna of EXAMPLE 2 fully met the specifications of VICS (reception frequency=2.499 GHz±1 MHz, a bandwidth at return loss of 10 dB=2.494–2.503 GHz).

EXAMPLE 3

Starting materials were formulated to provide the same composition as in EXAMPLE 1, mixed by wet ball milling, dried, crushed and calcined. The resultant calcined powder was mixed with polyvinyl butyral (PVB) as a binder and butyl phthalyl butyl glycolate (BPBG) as a plasticizer, and blended with ethyl alcohol as a solvent by a ball mill. The resultant blend was defoamed, adjusted with respect to viscosity, and then formed into a green sheet by a doctor blade method.

Figure 45:
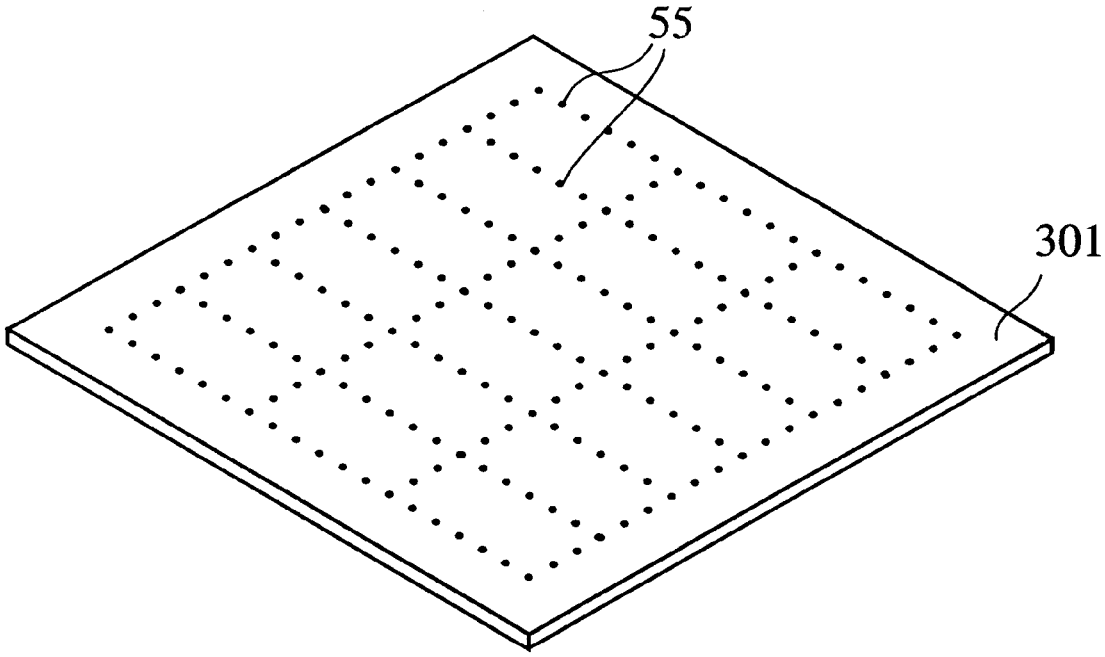
FIG. 45 is a perspective view showing a green sheet for an integral assembly produced in EXAMPLE 3.

After the green sheet was cut to a predetermined shape, it was provided with a plurality of through-holes by punching in a die having punching pins having diameters of about 0.5 mm and about 0.8 mm, respectively. FIG. 45 shows a green sheet 301 provided with a plurality of through-holes 55. The green sheet 301 was coated with an Ag paste by screen printing, while filling the through-holes 55 with the Ag paste by sucking. After drying the Ag paste, a plurality of green sheets 301 provided with Ag conductor layers were laminated and pressed together.

A laminate thus formed was printed with an Ag paste, an upper surface of the laminate was provided with a radiation conductor layer 21, a strip gap 3 and a strip conductor layer 4, and a bottom surface of the laminate was provided with a ground conductor layer 23. The resultant integral assembly 30 was cut to a predetermined shape, and each cut piece was disposed on an alumina jig for sintering. After degreasing at 600° C. in the air, it was sintered at 900° C. to produce a slot antenna for ETC in a shape of 5 mm×7.5 mm×3 mm as shown in FIG. 2. This slot antenna had conductor layer-free portions 12 discontinuous to a strip gap 3 (width: 1 mm) on a side surface, and a side of each conductor layer-free portion 12 was 2.7 mm. With respect to the resultant sample, input VSWR from a feeder was evaluated in the same manner as in EXAMPLE 1. As a result, it was found that this slot antenna had substantially the same characteristics as those of EXAMPLE 1.

EXAMPLE 4

After an integral assembly 30 prepared in the same manner as in EXAMPLE 3 was provided with snap lines 38 at positions corresponding to outer peripheries of insulating substrates, it was degreased at 600° C. in the air, sintered at 900° C. and then divided along the snap lines 38 to provide each slot antenna piece of 15 mm×7.5 mm×3 mm having conductor layer-free portions 12 on a side surface. With respect to the resultant sample, input VSWR from a feeder was evaluated in the same manner as in EXAMPLE 1. As a result, it was found that this slot antenna had substantially the same characteristics as those of EXAMPLE 1.

EXAMPLE 5

Formed on an insulating substrate 1 by a screen-printing method was a conductor layer in a pattern comprising a first conductor layer 2, a second strip conductor layer 4, strip gap 3 (width: 1 mm), and openings 11 (3 mm in each side) shaped as alphabet letters of ETC and discontinuous to the slot 3. The conductor layer was baked at 850° C. to provide a slot antenna for ETC in a shape shown in FIG. 6. With respect to the resultant slot antenna, input VSWR from a feeder was evaluated in the same manner as in EXAMPLE 1. As a result, it was found that this slot antenna had substantially the same characteristics as those of EXAMPLE 1.

EXAMPLE 6

Starting materials for calcium zirconate were formulated, mixed by wet ball milling, dried, crushed and calcined. The resultant calcined powder was mixed with PVA as a binder, compression-molded, and then sintered. The resultant sintered body was cut by a dicing machine to an insulating substrate 1 made of a dielectric calcium zirconate-based ceramic. The insulating substrate 1 had a dielectric constant of 30.

An outer surface of this insulating substrate 1 was coated with a conductive paste based on Ag by a screen printing method and baked at 850° C. to provide a slot antenna of 10 mm×15 mm×4 mm in a shape shown in FIG. 7. In the resultant slot antenna, a strip conductor layer 4 had a width of 1 mm, and a conductor layer-free portion la had a width of 0.5 mm. It was confirmed that the slot antenna had a frequency bandwidth of 8 MHz, wider than the bandwidth of 6.6 MHz in the conventional slot antenna.

EXAMPLE 7

A conductor layer was formed on an insulating substrate of 10 mm in length×15 mm in width×4 mm in height made of dielectric calcium zirconate-based ceramic, to provide a slot antenna having a shape shown in FIGS. 12(*a*)–(*c*) and the following dimensions:

a=10 mm, b=2.5 mm, c=5 mm, d=15 mm, and

Width of strip conductor layer 4=1 mm.

Figure 46:
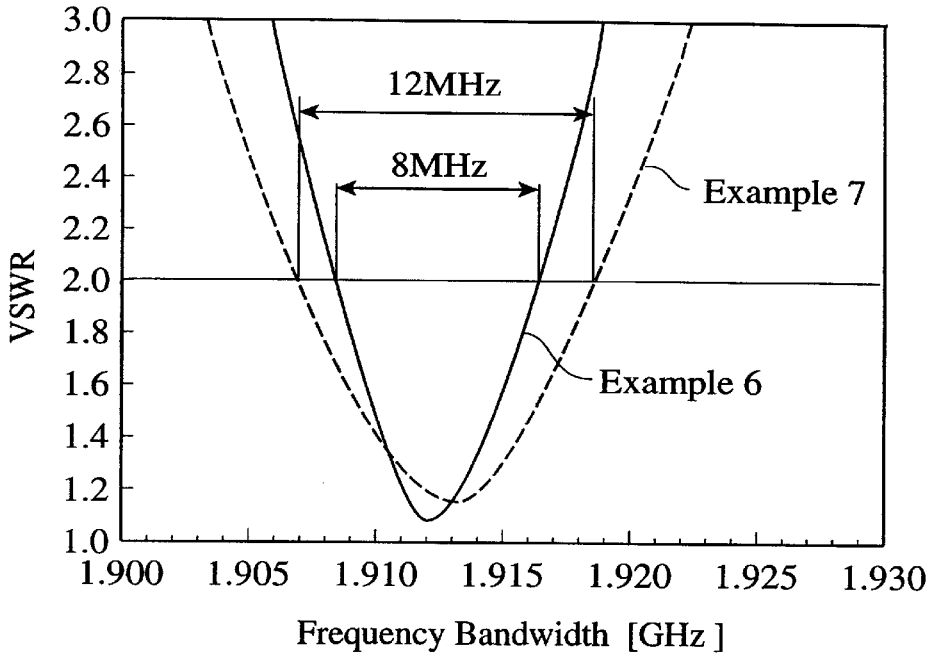
FIG. 46 is a graph showing the relation between VSWR and frequency in slot antennas in EXAMPLES 6 and 7.

VSWR (voltage-standing wave ratio) was measured with respect to the slot antennas of EXAMPLES 6 and 7. The results are shown in FIG. 46. In a graph of FIG. 46, the axis of ordinates represents VSWR, and the axis of abscissas represents frequency. Also, the solid line represents EXAMPLE 6, and the dotted line represents EXAMPLE 7. In FIG. 46, the bandwidth is defined as a frequency range in which VSWR is 2 or less. While the slot antenna of EXAMPLE 6 had a bandwidth of 8 MHz, the slot antenna of EXAMPLE 7 had as wide a bandwidth as 12 MHz.

Figure 47:
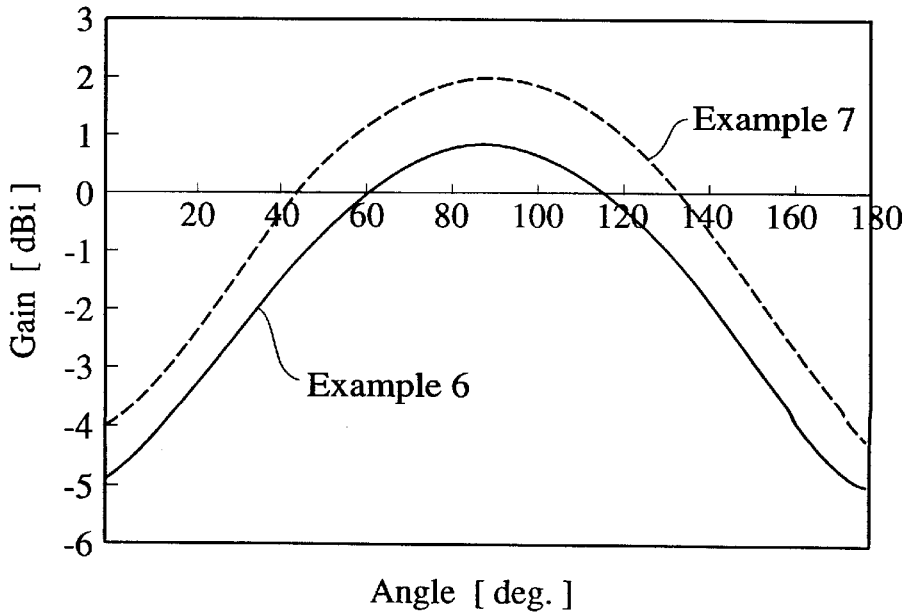
FIG. 47 is a graph showing the relation between radiation gain and an angle at which the radiation gain was measured in slot antennas in EXAMPLES 6 and 7.

The radiation gain of the slot antenna of EXAMPLES 6 and 7 were also measured. The results are shown in FIG. 47. In a graph of FIG. 47, the axis of ordinates represents radiation gain, and the axis of abscissas represents an angle at which the radiation gain was measured. Also, the solid line represents EXAMPLE 6,and the dotted line represents EXAMPLE 7. While the slot antenna of EXAMPLE 6 had a radiation gain of 0.8 [dBi], the slot antenna of EXAMPLE 7 had as high a radiation gain as 2 [dBi].

It was confirmed from the above experimental results that both of the frequency bandwidth and the radiation gain were improved by providing the first conductor layer with slit gaps in perpendicular to the direction of electric current.

EXAMPLE 8

Using an antenna element shown in FIG. 12, in which c=a/2, and $0.1 \geqq b/a \geqq 0.4$, a bandwidth and a radiation gain were measured. While a relative bandwidth was 0.57% in the case of b/a=0.1, it was improved to 0.63% or more with a radiation gain improved to 0.8 dB or more in the case of $b/a \geqq 0.15$. Also in the case of b/a>0.35, the relative bandwidth necessary for having a bandwidth of 20 MHz at 1.9 GHz was 1% or more. Thus, the preferred range of b/a is 0.1–0.4.

EXAMPLE 9

In an antenna element shown in FIG. 12, b/a=0.25, and $0.2 \leqq c/a \leqq 0.8$. While a relative bandwidth was 0.36% in the case of c/a=0.2, it was improved to 0.55% or more with a radiation gain improved to 1.5 dB or more in the case of c/a>0.4. Also in the case of c/a>0.6, both of the relative bandwidth and the radiation efficiency were saturated.

EXAMPLE 10

Using the same conductor, dielectric ceramic material and printing method as in EXAMPLE 6,a slot antenna having two or three parallel slit gaps 15 in perpendicular to the direction of electric current as shown in FIG. 13 was produced. The slot antenna in this EXAMPLE was 10 mm in length, 15 mm in width and 4 mm in height, each slit gap 15 was 15 mm in total length and 0.5 mm in width, and the strip conductor layer 4 was 1 mm in width.

Figure 48:
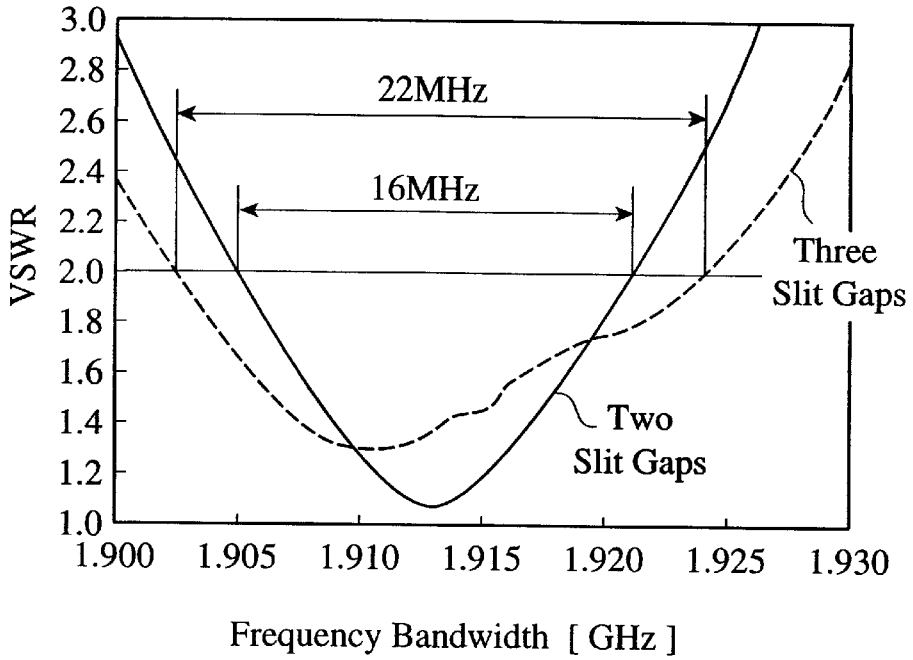
FIG. 48 is a graph showing the relation between VSWR and frequency in a slot antenna in EXAMPLE 10.
Figure 49:
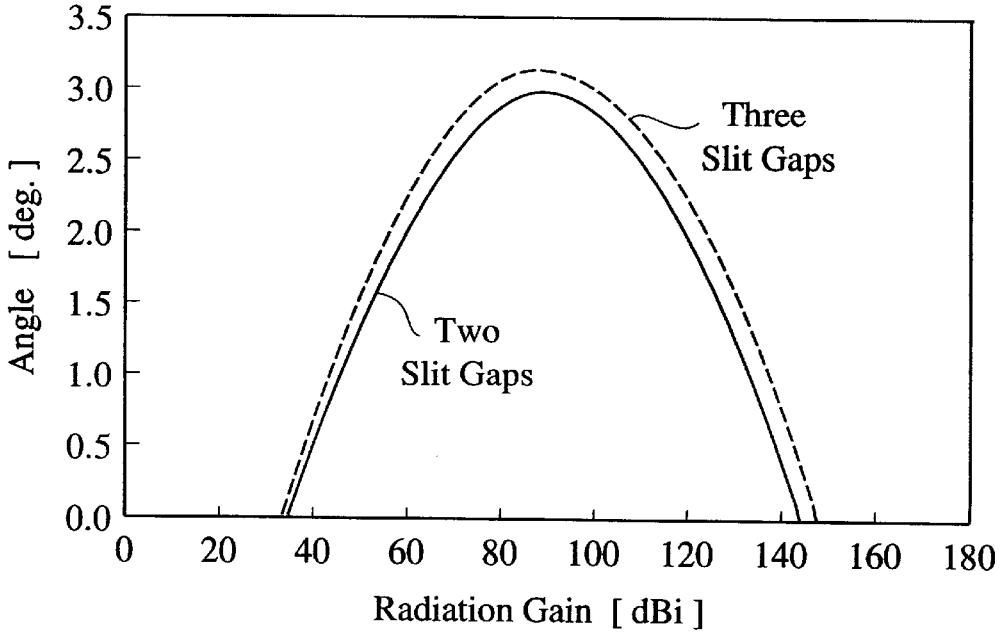
FIG. 49 is a graph showing the relation between radiation gain and an angle at which the radiation gain was measured in a slot antenna in EXAMPLE 10.

The slot antenna of this EXAMPLE was measured with respect to VSWR (voltage-standing wave ratio) and radiation gain. FIG. 48 shows the bandwidth determined from VSWR, and FIG. 49 shows the relation between the radiation gain and an angle at which it was measured. In each figure, the solid line represents a slot antenna having two slit gaps 15, and the dotted line represents a slot antenna having three slit gaps 15. In the case of two slit gaps 15, the bandwidth was 16 MHz and the radiation gain was 2.8 [dBi]. Also, in the case of three slit gaps 15, the bandwidth was 22 MHz and the radiation gain was 3.1 [dBi]. It was found from these results that the larger the number of the slit gaps 15, the more the performance of the antenna was improved.

As described above in detail, a slot antenna showing little variable resonance frequency and VSWR and easy for impedance matching with a feeder can be obtained by providing an outer surface of an insulating substrate with a first conductor layer and by forming a second conductor layer in a strip gap or in an insulating extension connected to the slot according to the present invention. Also, by providing a conductor layer-free portion on a side surface of the insulating substrate to define a strip gap, the freedom of design of a slot antenna is dramatically increased, and characteristics such as bandwidth and radiation gain can be improved with easy miniaturization and reduction of thickness.

Further, by giving one or more slit gaps to the first conductor layer, it is possible to provide an antenna element having low Q and large bandwidth and radiation gain.

In addition, because a first conductor layer and a second conductor layer can be formed on an outer surface of an insulating substrate having a high dielectric constant by a screen-printing method, etc., the production cost of an antenna element can be drastically reduced. The antenna element of the present invention having such a structure is advantageous in easiness in miniaturization and reduction of thickness.

What is claimed is:

1. An antenna element comprising:

an insulating substrate;

a first conductor layer at least partially formed on an upper surface, a bottom surface, and at least one side surface of said insulating substrate;

a strip gap comprising a portion in which a conductor layer is not formed on at least one of an upper surface and a side surface of said insulating substrate; and a second strip conductor layer formed in an insulated extension connected to said strip gap and formed on one or more surfaces of said insulating substrate thereby being electrically insulated from said first conductor layer, said second strip conductor layer being electrically connected to a feeder.

2. The antenna element according to claim 1, wherein said second strip conductor layer has at a tip end an extension that is trimmed to control the length of said second strip conductor layer.

3. The antenna element according to claim 2 wherein the tip end of the second strip conductor layer is trimmed to achieve impedance matching with the feeder.

4. An antenna element comprising:

an insulating substrate;

a first conductor layer at least partially formed on an upper surface, a bottom surface, and at least one side surface of said insulating substrate;

a strip gap comprising a portion in which a conductor layer is not formed on at least one of an upper surface and a side surface of said insulating substrate; and a second strip conductor layer formed in said strip gap or in an insulated extension connected to said strip gap and formed on one or more surfaces of said insulating substrate thereby being electrically insulated from said first conductor layer, said second strip conductor layer being electrically connected to a feeder, wherein said strip gap is formed at least on a side surface of said insulating substrate opposite to the side surface on which said first conductor layer is formed.

5. The antenna element according to claim 4, wherein said second strip conductor layer exists in said strip gap at a position opposite to the side surface of said insulating substrate on which said first conductor layer is formed.

6. The antenna element according to claim 4, wherein said first conductor layer formed on the upper surface of said insulating substrate is divided by at least one slit gap extending substantially in perpendicular to the direction of electric current at a position separated from said strip gap.

7. The antenna element according to claim 5, wherein said first conductor layer formed on the upper surface of said insulating substrate is divided by at least one slit gap extending substantially in perpendicular to the direction of electric current at a position separated from said strip gap.

8. The antenna element according to claim 4, wherein said second strip conductor layer has at a tip end an extension that is trimmed to control the length of said second strip conductor layer.

9. The antenna element according to claim 6, wherein said slit gap is in parallel with said strip gap.

10. The antenna element according to claim 4, wherein the tip end of the second strip conductor is trimmed to achieve impedance matching with the feeder.

11. The antenna element according to any one of claims 4, 5, 6, and 7, wherein said insulating substrate is made of a ceramic based on alumina or calcium zirconate.

12. The antenna element according to any one of claims 1, 2, 8, 9 and 10, wherein said insulating substrate is made of a ceramic based on alumina or calcium zirconate.

13. A radio communications apparatus comprising said antenna element defined in any one of claims 1, 2, 8 and 9.

14. An antenna element comprising:

an insulating substrate;

a first conductor layer at least partially formed on an upper surface, a bottom surface, and at least one side surface of said insulating substrate;

a strip gap comprising a portion in which a conductor layer is not formed on at least one of an upper surface and a side surface of said insulating substrate; and a second strip conductor layer formed in said strip gap or in an insulated extension connected to said strip gap and formed on one or more surfaces of said insulating substrate thereby being electrically insulated from said first conductor layer, said second strip conductor layer being electrically connected to a feeder, wherein said first conductor layer formed on the upper surface of said insulating substrate is divided by at least one slit gap extending substantially in perpendicular to the direction of electric current at a position separated from said strip gap, wherein an area $S_b$ of said slit gap and an area $S_a$ of a radiation region of said first conductor layer have a ratio $S_b/S_a$ of 0.05 or more.

15. The antenna element according to claim 14, wherein the ratio $S_b/S_a$ is optimized to control radiation loss of the antenna element.

16. A radio communications apparatus comprising said antenna element defined in any one of claims 4, 5, 6, 7, and 14.

17. An antenna element comprising:

an insulating substrate;

a first conductor layer at least partially formed on an upper surface, a bottom surface, and at least one side surface of said insulating substrate;

a strip gap comprising a portion in which a conductor layer is not formed on at least one of an upper surface and a side surface of said insulating substrate; and a second strip conductor layer formed in said strip gap or in an insulated extension connected to said strip gap and formed on one or more surfaces of said insulating substrate thereby being electrically insulated from said first conductor layer, said second strip conductor layer being electrically connected to a feeder, wherein said first conductor layer formed on the upper surface of said insulating substrate is divided by at least one slit gap extending substantially in perpendicular to the direction of electric current at a position separated from said strip gap, wherein a ratio c/a of a distance c from said second conductor layer to said slit gap to a distance a from said second conductor layer to the side surface of said insulating substrate, on which said first conductor layer is formed, is 0.1 or more.

18. The antenna element according to claim 17, wherein the ratio c/a is optimized to control radiation loss of the antenna element.

* * * * *

UNITED STATES PATENT AND TRADEMARK OFFICE

CERTIFICATE OF CORRECTION

PATENT NO. : 6,452,554 B1
DATED : September 17, 2002
INVENTOR(S) : Hiroyuki Aoyama et al.

It is certified that error appears in the above-identified patent and that said Letters Patent is hereby corrected as shown below:

Title page, Item [54] and Column 1, lines 1 and 2,
"RADIO COMMUNICATION" should read -- RADIOCOMMUNICATION --.
Item [57], ABSTRACT,
Line 7, delete "slot" and insert -- strip gap --.

Signed and Sealed this

Eleventh Day of February, 2003

JAMES E. ROGAN
*Director of the United States Patent and Trademark Office*